US011412854B2

(12) United States Patent
Welch et al.

(10) Patent No.: US 11,412,854 B2
(45) Date of Patent: Aug. 16, 2022

(54) SELF-STOPPING MOBILE CHAIR SYSTEM

(71) Applicant: LPA MEDICAL INC., Quebec (CA)

(72) Inventors: Bryan Welch, Quebec (CA); Yvon St-Onge, Quebec (CA); Normand Chamberland, Quebec (CA); Martin Belanger, Quebec (CA)

(73) Assignee: LPA MEDICAL INC., Quebec (CA)

( * ) Notice: Subject to any disclaimer, the term of this patent is extended or adjusted under 35 U.S.C. 154(b) by 43 days.

(21) Appl. No.: 17/094,873

(22) Filed: Nov. 11, 2020

(65) Prior Publication Data

US 2021/0177148 A1 Jun. 17, 2021

Related U.S. Application Data

(60) Provisional application No. 62/947,714, filed on Dec. 13, 2019.

(51) Int. Cl.
*A47C 3/03* (2006.01)
*A47C 3/025* (2006.01)

(52) U.S. Cl.
CPC ..... *A47C 3/03* (2013.01); *A47C 3/0255* (2013.01)

(58) Field of Classification Search
CPC ..... A47C 3/0255; A47C 3/03; A47C 3/025
USPC ..... 297/259.3, 270.4
See application file for complete search history.

(56) References Cited

U.S. PATENT DOCUMENTS 3,339,972 A 9/1967 Fletcher
6,120,094 A * 9/2000 Parent ..... A47C 3/03 297/270.3
6,213,551 B1 * 4/2001 Desnoyers ..... A47C 3/025 297/270.3
6,244,658 B1 * 6/2001 Parent ..... A47C 3/03 297/270.3
6,406,095 B1 6/2002 Bouchard et al.
6,588,841 B1 * 7/2003 Hoffman ..... A47C 3/0255 297/270.3
6,997,510 B2 * 2/2006 Guillot ..... A47C 3/0255 297/270.4
7,334,840 B2 2/2008 Deans et al.
8,517,463 B2 8/2013 Murphy et al.
(Continued)

FOREIGN PATENT DOCUMENTS

CA 2855283 A1 * 3/2015 ..... A47C 3/02

*Primary Examiner* — Milton Nelson, Jr.

(74) *Attorney, Agent, or Firm* — Norton Rose Fulbright Canada LLP

(57) ABSTRACT

A self-stopping mobile chair system comprising: a chair including a base, a joint and a seat coupled to the base via the joint to allow a movement of the seat relative to the base between a fore position and an aft position; a locking mechanism configurable between: an engageable state in which the locking mechanism locks the seat upon the seat being in a rated position between the fore and aft positions, the seat movable toward the rated position to be locked by the locking mechanism, and a disengaged state in which the seat is movable between the fore and aft positions unhindered; and an actuator connected between the seat and the locking mechanism to configure the locking mechanism either in the disengaged state upon the seat bearing a force or in the engageable state absent the force. There is also provided a movement stopping system for a mobile chair.

20 Claims, 8 Drawing Sheets

(56) References Cited

U.S. PATENT DOCUMENTS

| | | | | |
|---|---|---|---|---|
| 2007/0096522 | A1* | 5/2007 | Bergeron | A47C 3/0255<br>297/270.1 |
| 2011/0148161 | A1 | 6/2011 | Fontaine | |

* cited by examiner

SELF-STOPPING MOBILE CHAIR SYSTEM

CROSS-REFERENCE TO RELATED APPLICATIONS

The present application claims priority to U.S. provisional patent application No. 62/947,714 filed Dec. 13, 2019, the entire contents of which are incorporated by reference herein.

TECHNICAL FIELD

The present application relates generally to mobile chairs and, more particularly, to systems provided for stopping a movement of such mobile chairs.

BACKGROUND OF THE ART

Mobile chairs are typically provided with one or more joints enabling their seat to be moved by some degree relative to an underlying structure, whether for leisure (for example a gliding linkage allowing the seat to be reciprocated fore and aft relative to a base of the chair), for comfort (such as by way of a reclining mechanism allowing a backrest of the seat to be tilted relative to the base), or for utility (as the case may be with a wheelchair). Such joints typically require active user involvement for both the enablement of movements between articulated structures of the chair and also for the hindrance of such movements. Actuation means via which the user must interact to carry out these tasks are known to detract from overall stability and ergonomics of the chair, particularly with respect to ingress and egress.

SUMMARY

In accordance with an aspect of the present technology, there is provided a self-stopping mobile chair system comprising: a chair including a base, a joint assembly and a seat kinematically coupled to the base via the joint assembly to allow a movement of the seat relative to the base between a fore seat position and an aft seat position; a locking mechanism configurable between: an engageable state in which the locking mechanism locks the seat so as to hinder the movement upon the seat being in a rated seat position between the fore and aft seat positions, the seat movable toward the rated seat position to be locked by the locking mechanism, and a disengaged state in which the seat is movable between the fore and aft seat positions unhindered by the locking mechanism; and an actuator operatively connected between the seat and the locking mechanism so as to configure the locking mechanism either in the disengaged state upon the seat bearing a rated force or in the engageable state absent the rated force.

In some embodiments, the seat includes a seat deck facing away from the base and the joint assembly, the seat settling into the rated seat position upon a sole external force exerted against the seat being a rated weight borne by the seat deck and into a baseline seat position rearward of the rated seat position absent external force.

In some embodiments, the rated force is of a magnitude less than that of the rated weight.

In some embodiments, the seat includes a resting module adjacent to the seat deck, the resting module movable relative to the seat deck between a sitting module angle and a resting module angle greater than the sitting module angle, the engageable state being a first engageable state and the locking mechanism being configured in a second engageable state in which the locking mechanism locks the seat upon the seat bearing the rated force and the resting module being at a threshold module angle between the sitting module angle and the resting module angle.

In some embodiments, the disengaged state is a first disengaged state, the locking mechanism being configured in a second disengaged state in which the seat is movable between the fore and aft seat positions unhindered by the locking mechanism upon the seat bearing the rated force and the resting module being at an angle between the sitting module angle and the threshold module angle.

In some embodiments, the actuator is a first actuator and the rated force is a first rated force, the mobile chair system comprising a second actuator operatively connected between the seat and the locking mechanism so as to configure the locking mechanism in the second engageable state upon the seat bearing a second rated force.

In some embodiments, the joint assembly includes a gliding linkage including a link having a first connector pivotally joined to the base and a second connector spaced from the first connector and pivotally joined to the seat, the link pivoting about the first connector and relative to a vertical orientation of the base from a baseline link angle to a rated link angle as the seat moves from the baseline seat position to the rated seat position, the rated link angle being less than the baseline link angle.

In some embodiments, the rated link angle is between 5% and 35% of the baseline link angle.

In some embodiments, the link is a fore link and the first and second connectors are fore first and second connectors, the gliding linkage including an aft link rearward of the fore link, the aft link having an aft first connector pivotally joined to the base rearward of the fore first connector and an aft second connector spaced from the aft first connector and pivotally joined to the seat, a horizontal distance between the fore second connector and a point intermediate the fore and aft first connectors increases from a baseline link distance to a rated link distance as the seat moves from the baseline seat position to the rated seat position.

In some embodiments, the rated link distance is between 15% and 51% of a distance between the fore first connector and the aft first connector.

In some embodiments, the locking mechanism includes a pair of lockable components and a latch movably connected to a first component of the lockable components to be movable relative to a second component of the lockable components between a disengaged position and an engaged position, the latch biased toward the engaged position and actuable toward the disengaged position.

In some embodiments, the first and the second components are mechanically attached to a respective one of the seat, the base and the joint assembly.

In some embodiments, the second lockable component is affixed to a link of the joint assembly being pivotally connected to the base and to the seat and the first lockable component is affixed to one of the base and the seat.

In some embodiments, the latch has a latch connector pivotally connected to the first component and a retentive shape defined at a location spaced radially away from the latch connector, the retentive shape arranged to engage with the second component upon the locking mechanism being in the engageable state and the seat being in the rated seat position.

In accordance with another aspect of the present technology, there is provided a movement stopping system for a mobile chair including a base, a joint assembly and a seat kinematically coupled to the base via the joint assembly to allow a movement of the seat relative to the base between a fore seat position and an aft seat position, the movement stopping system comprising: a locking mechanism including a pair of lockable components adapted to be mountable to the chair and a latch movably connected to a first component of the lockable components to be movable relative to a second component of the lockable components between a disengaged position and an engaged position, the latch biased toward the engaged position and actuable toward the disengaged position, the lockable components being movable relative to one another between a first following position and a second following position of a range of following positions, and the second lockable component being caught by the latch upon the latch moving into the engaged position with the lockable components being at a lockable position of the range of following positions, the latch being clear of the second component when in the disengaged position, and an actuator operatively connected to the latch and operable to urge the latch into the disengaged position.

In some embodiments, the first and the second components are configured to be mechanically attached to a respective one of the seat, the base and the joint assembly, and the actuator is configured to be operable via the seat.

In some embodiments, the latch has a latch connector pivotally connected to the first component and a retentive shape defined at a location spaced radially away from the latch connector, the retentive shape arranged to slidably engage with the second component upon the lockable components being in the lockable position and the latch moving into the engaged position.

In some embodiments, the latch is biased to pivot relative to the first component away from the disengaged position and toward the engaged position, the actuator including an input device and a cable arranged between the input device and the latch such that the cable is tensionable via the input device so as to force the latch to pivot away from the engaged position to the disengaged position upon the input device bearing a rated force.

In some embodiments, the actuator has a sliding mechanism arranged for increasing an effective length of the cable.

In some embodiments, the latch is a first latch of the locking mechanism and the actuator is a first actuator of the movement hindering system, the locking mechanism including a second latch movably connected to the first component to be movable relative to the second component between a respective disengaged position and a respective engaged position, biased toward the respective engaged position and actuable toward the respective disengaged position, the second latch interlocking the lockable components at a respective lockable position of the range of following positions when in the respective engaged position, the second latch being clear of the second component when in the respective disengaged position, and the movement stopping system including a second actuator operatively connected to the second latch and configured to be operable via the seat such that the first latch and the second latch are actuable independently.

DESCRIPTION OF THE DRAWINGS

Reference is now made to the accompanying figures in which.

DETAILED DESCRIPTION

The present disclosure relates to self-locking chair technology provided for selectively locking movements of a mobile chair upon sensing an intent of a user to egress from such chair as disclosed in U.S. Pat. No. 6,406,095, the contents of which are incorporated herein by reference.

General Description

Figure 1:
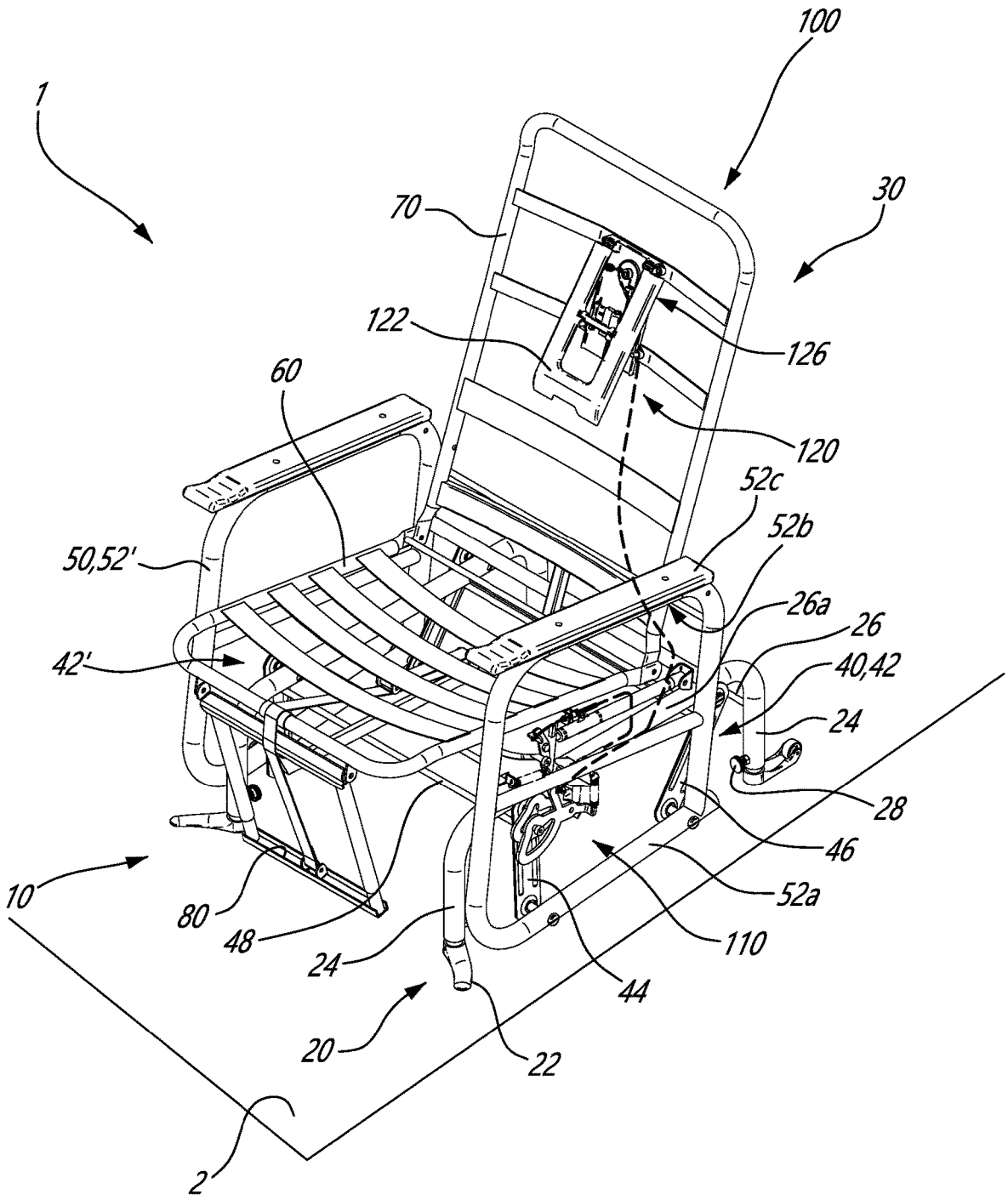
FIG. 1 is a perspective view of a mobile chair system including a base, a seat, a linkage coupling the seat to the base, and a movement stopping system including a locking mechanism mounted relative to the base and to the linkage.

With reference to FIG. 1, a mobile chair system 1 according to an aspect of the present technology will now be generally described. The mobile chair system 1 generally includes a chair 10 of a mobile type, i.e., a chair having seating and ground-interfacing structures joined to one another and arranged such that one or more movements of the seating structure can be induced relative to the ground-interfacing structure and the underlying ground. The mobile chair system 1 also includes a movement stopping system 100 (FIG. 2) configured with respect to mobile and load-bearing elements of the chair 10 to automatically either hinder the one or more movements or give way thereto depending on certain operating conditions of the chair 10. Such operating conditions of the chair 10 may be indicative of whether a user has taken place on the chair 10 and/or whether the user may be attempting to ingress thereto, to egress therefrom, or to effect the one or more movement. As will become apparent from the forthcoming description, the movement stopping system 100 may desirably assist a user by locking the chair 10 in a suitable position upon the user attempting ingress or egress thereof and, conversely, by give way to movement of the chair 10 upon the user being seated therein, in either case without requiring any action by the user specifically intended to such effect. Therefore, the movement stopping system 100 may advantageously render the chair 10 stationary in a spontaneous and timely manner, at least under certain pre-determined circumstances, as may be convenient for example to users with cognitive impairment.

Hence, in embodiments, the chair 10 includes ground-interfacing and seating structures in the forms of a base 20 and a seat 30 supported thereby. The seat 30 is kinematically coupled to the base 20 by one or more joint assemblies 40 of the chair 10. In other words, the seat 30 is joined to the base 20 by a means suitable for allowing the one or more movements, which may include gliding/rocking, reclining/pivoting and even rolling/rotating, some examples of which will be described hereinbelow.

The chair 10 may be said to be of a conventional construction insofar as its structure, dimensions and materials provide conventionally expected load-bearing capacity, function and comfort characteristics. The base 20 may be generally described as a rigid structure having a ground-facing side with feet 22 suitable for distributing loads imparted from the seat 30 onto a generally planar ground surface 2 while the base 20 remaining substantially stationary. Legs 24 of the base 20 project from the feet 22 away from the ground-facing side, and support members 26 of the base 20 extend between the legs 24 transversely thereto, defining a seat-facing side of the base 20 opposite the ground-facing side and facing away from the ground surface 2. On either side of the base, generally horizontal support members 26*a* extend between aft and fore legs 24. The base 20 may be provided with one or more leveling means on its ground-facing side arranged for orienting the seat-facing side generally horizontally should the need arise, for example to compensate for an uneven ground surface 2. Leveling the base 20 may assist in orienting the seat 30 such that the movement of the seat 30 relative to the base 20 is affected by gravity in a predetermined manner. The leveling means may for example include screws or other means suitable for selectively spacing the feet 22 from their corresponding legs 24. Each of the feet 22 may be independently adjustable relative to their corresponding legs 24 so as to induce a desired levelling effect. Further, it will be appreciated that adjusting the feet 22 relative to their corresponding legs 24 can desirably adjust a position of the base 20 and of the seat 30 relative to the ground surface 2 according to anthropometric characteristics of the user. Each foot 22 and its corresponding leg 24 may form a telescopic structure that is adjustable in length. In some such implementations, a set screw 28 or other suitable fastener may be provided for binding the leg 24 to its corresponding foot 22 in one of a series of predetermined positions. The series of predetermined positions may be defined by a series of indexing features, such as holes, disposed along a shank of the foot 22 received inside a hollow interior of the leg 24. Based on the location of the set screw 28 relative to the leg 24 and the locations of the indexing features relative to the foot 22, a series of predetermined heights at which the base 20 may be selectively set is defined. One or more of the feet 22 or legs 24 may in some implementations be provided with caster wheels.

Figure 3:
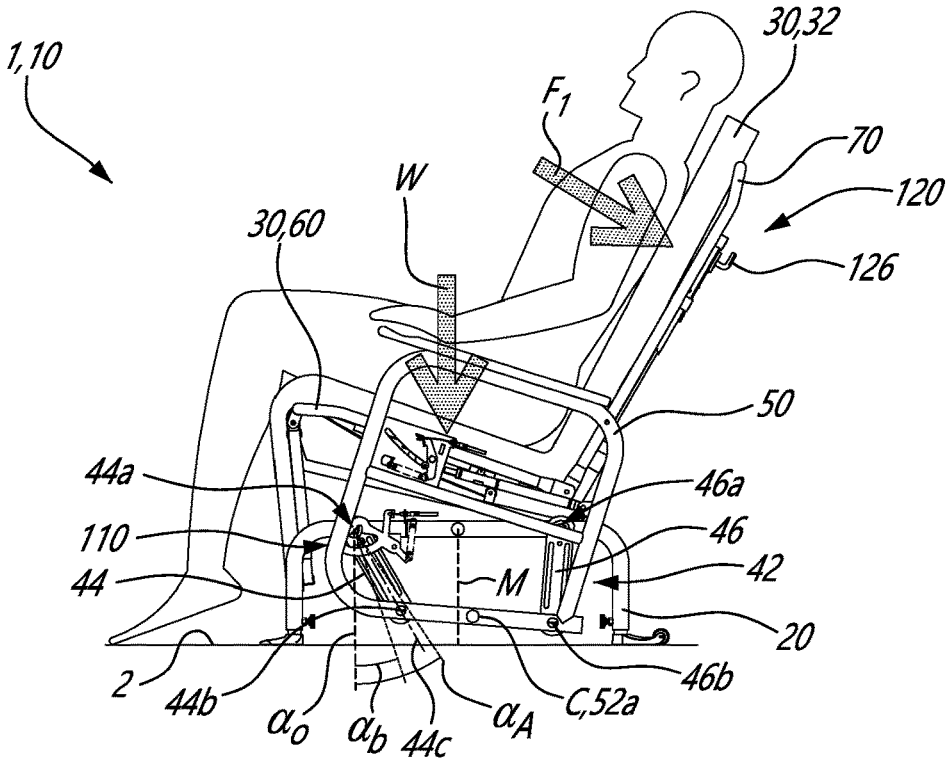
FIG. 3 is a left side elevation view of the mobile chair system of FIG. 1, the seat shown in an aft seat position of a gliding movement relative to a base of the chair rearward of a baseline seat position being another position of the gliding movement, the locking mechanism of FIG. 2 shown configured in a disengaged state.
Figure 4:
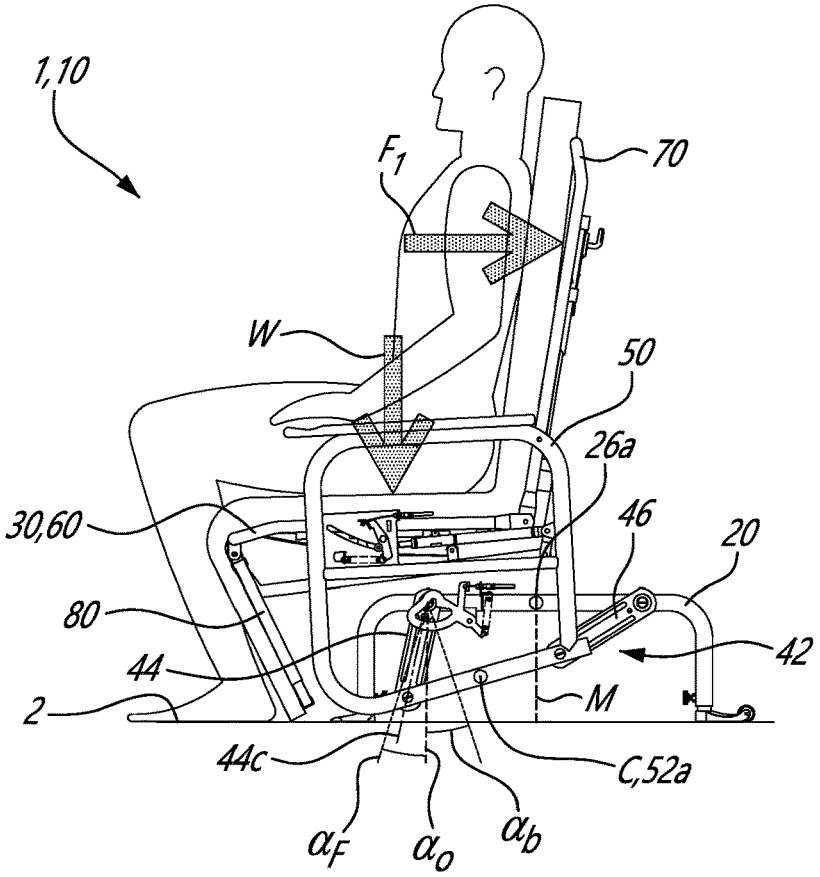
FIG. 4 is a left side elevation view of the mobile chair system of FIG. 1, the seat shown in a fore seat position of the gliding movement forward of the baseline seat position in yet another position of the gliding movement, the locking mechanism still configured in the disengaged state.

Still referring to FIG. 1, the seat 30 generally includes a frame 50, a deck 60 supported by the frame 50, as well as a backrest 70 and a legrest 80 respectively disposed at the rear and the front of the deck 60. One or more of such load-bearing modules of the seat 30 may be lined with suitable upholstery 32, for example the deck 60, the backrest 70 and the legrest 80 as shown in FIGS. 3, 4 and 8 and otherwise removed for clarity. In this exemplary arrangement of the seat 30, the frame 50 has two side frames 52, 52' disposed opposite one another on either side of the deck 60 and outward of the base 20. Each one of the side frames 52, 52' extends generally forwardly relative to the backrest 70, and generally upwardly between respective bottom frame members 52*a* located below the deck 60 and top frame members 52*b* located above the deck 60. An armrest 52*c* of the seat 30 is disposed onto each of the top frame members 52*b*. The side frames 52, 52' form rigid structures fixedly connected to one another by transverse members (not shown in detail) of the frame 50 extending therebetween, enabling the frame 50 to support a remainder of the seat 30 and to transmit static and dynamic loading conditions (e.g., forces, moments) imparted thereto toward one or more of the joint assemblies 40 such that movements of the chair 10 may be effected.

Although the present technology also applies to chairs enabling a sole movement, the chair 10 instantly described and depicted is arranged such that two movements, namely gliding and reclining movements, may be imparted to the seat 30 relative to the base 20. The chair 10 can thus be described as a gliding chair, granted it may be referred to otherwise (e.g., a glider, a rocking chair, etc.) Indeed, a first joint assembly 40 of the chair 10 is provided in the form of a gliding linkage 42 mounted between the base 20 and the seat 30 and arranged so as to allow and govern a gliding movement of the seat 30 relative to the underlying base 20 and ground surface 2. The chair 10 in this case includes two gliding linkages 42, 42' (FIG. 2B) laterally spaced apart so as to be respectively disposed proximate one of the side frames 52, 52'. The gliding linkage 42 includes a first link 44 and a second link 46 disposed fore (44) and aft (46) relative to one another. Each one of the fore and aft links 44, 46 has a pair of connectors spaced apart lengthwise and respectively pivotally connected to the base 20 and to the seat 30. A corresponding link of the opposite linkage 42' is connected to each of the links 44, 46 via a transverse member 48 arranged to coordinate both gliding linkages 42, 42'. It should be noted that the present description will henceforth focus on the side of the mobile chair system 1 corresponding to the gliding linkage 42 for brevity, and that like elements, features and characteristics pertaining to the opposite side of the mobile chair system 1 should be deemed equivalent, mutatis mutandis, unless stated otherwise. The chair 10 of the instant rendition of the technology may also be described as a reclining chair, among other suitable designations (e.g., a recliner). A second joint assembly 40 of the chair 10 is a reclining mechanism 90 (FIG. 6) built into the seat 30 by way of which the frame 50, the deck 60, the backrest 70 and the legrest 80 are interconnected so as to govern the reclining movement of the seat 30 relative to the base 20. Further characteristics of the reclining mechanism 90 will be detailed hereinbelow.

Movement Stopping System

The movement stopping system 100 generally comprises a locking mechanism 110 and an actuator 120 mounted to the chair 10 remotely from one another, respectively on a ground-facing side and a user-facing side of the seat 30. The locking mechanism 110 is selectively configurable in either of the above-mentioned states based on an input received from the actuator 120. To this effect, the actuator 120 includes at least one input device 122 operable via the seat 30 and operatively connected to the locking mechanism 110 by way of an input transmission means 124. Depending on the implementation, the locking mechanism 110 may be operable via one or more seating element of the seat 30, such as the armrests 52*c*, the seat deck 60, the backrest 70 and the legrest 80. Any load-bearing module of the seat 30 provided with an input device may be described as an input module. In the depicted exemplary implementation of the actuator 120, the input device 122 is a trigger-like assembly secured to the backrest 70. Biased toward a first position in which it projects from a user-facing side of the backrest 70, the input device 122 is arranged to deflect inwardly relative to the backrest 70, away from the first position and toward a second position upon bearing a rated force F1 (FIGS. 3, 4). The rated force F1 consists in a force of a predetermined magnitude indicative of a user being firmly yet passively supported by the seat 30 with their back leaned against the backrest 70. The actuator 120 is arranged such that the input device 122 moves from the first position to the second position upon bearing the rated force F1, and thus exerts a resulting actuation force of a magnitude sufficient for urging the locking mechanism 110 from its engageable state to its disengaged state via the input transmission means, in this case provided in the form of a Bowden-type cable assembly 124. Such cable assembly 124 is adapted to transmit mechanical forces along its length, and yet may extend non-linearly between the input device 122 and the locking mechanism 110 if need be. The transmission of forces by the cable assembly 124 results from a movement of a wire 124*a* slidably received in a sheath 124*b* (FIG. 2) of the cable assembly 124. A first end and a second end of the sheath 124*b* opposite one another are respectively held stationary relative to mounting features of the input device 122 and of the locking mechanism 110, whereas corresponding ends of the wire 124*a* are respectively connected to mobile features of the input device 122 and of the locking mechanism 110. The actuator 120 may include a selective input means 126 (FIG. 3) arranged for selectively altering an input otherwise transmissible from the input device 122 to the locking mechanism 110. Here, the selective input means 126 is a hand-operable mechanism interfacing between the input device 122 and the cable assembly 124 such that it may be used to selectively lengthen or shorten an effective length of the wire 124*a*. Lengthening the effective length past a certain value may thus render the locking mechanism 110 inoperable by way of the input device 122.

Figure 2:
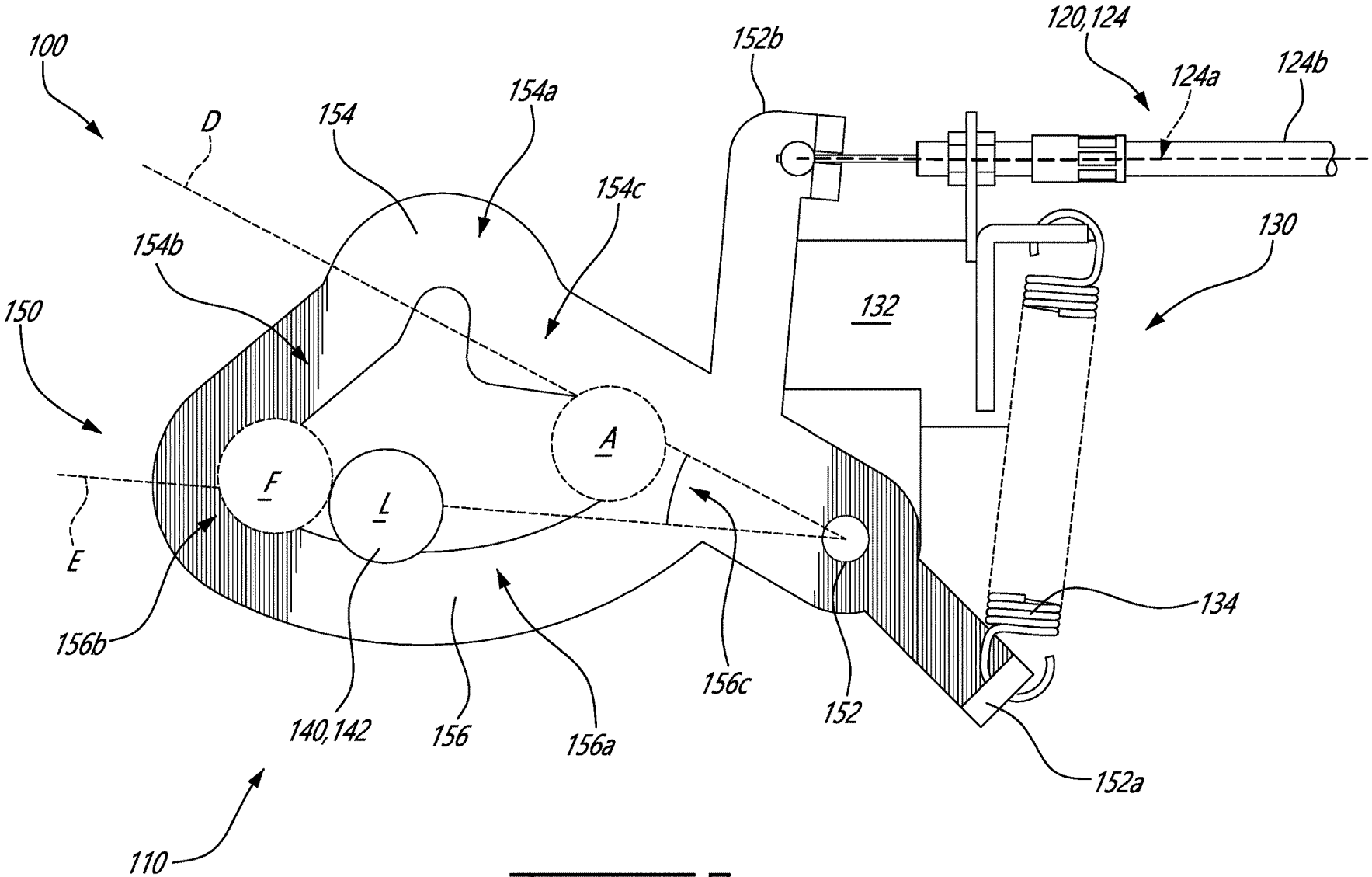
FIG. 2 is a schematic, close-up view of the locking mechanism of FIG. 1, with first and second lockable components of the locking mechanism shown in a lockable position relative to one another and a latch of the locking mechanism shown in a disengaged position and in an engaged position relative to the lockable components.

In FIG. 2, the locking mechanism 110 is schematically shown from up close and isolated from the chair 10. The locking mechanism 110 generally includes a pair of lockable components 130, 140 each mounted to respective mobile elements of the chair 10, and a latch 150 movable relative to the lockable components 130, 140 and connected to the input transmission means 124 to be controllably moved via the actuator 120. The lockable components 130, 140 and the latch 150 are arranged to be positionable relative to one another to become interlocked so as to hold the seat 30 in place via the mobile elements and thus stop the gliding movement. Via movement of the latch 150, the locking mechanism 110 is configurable between an engageable state in which stoppage of the gliding movement can occur under certain circumstances, and a disengaged state in which the lockable components 130, 140 and the latch 150 are either held stationary or constrained to move clear of one another such that the requisite position for them to become interlocked cannot be attained.

The mobile elements (absent from FIG. 2 for clarity) relative to which the locking mechanism 110 is mounted represent load-bearing structures of the chair 10 whose relative position changes as the gliding movement occurs. Such change in the relative position of the mobile elements defines a following movement of the locking mechanism 110 that is coupled to the gliding movement. As neither of the following movement and the gliding movement can occur without the other, hindering the following movement hinders the gliding movement, and vice versa. Depending on the implementation of the locking mechanism 110, either a single one or both of the mobile elements to which the lockable components 130, 140 are mounted are among elements of the seat 30 and the linkage 42 or among elements fixedly connected thereto. Hence, in some implementations, one of the lockable components 130, 140 is among elements of the base 20, or is at least connected thereto. In the present embodiment, a first component 130 of the lockable components 130, 140 has a bracket-like structure 132 mounted to the base 20 along its support member 26*a*. A second component 140 of the lockable components 130, 140 includes a holdable member 142 fixedly mounted to the fore link 44 and projecting laterally therefrom, in this case away from an exterior side of the fore link 44. Each one of the first component 130 and the second component 140 includes a joining means suitable for establishing a rigid connection with its corresponding mobile element, such as fastener(s), welding, and even heavy-duty adhesive. The latch 150 is a rigid piece having a latch connector 152 movably connected to the bracket 132 of the first component 130, and a holding member 154 spaced radially away from the latch connector 152. The latch 150 is movable between a disengaged position D and an engaged position E relative to the first component 130, in this case pivotally so about an axis of the latch connector 152, which may thus be referred to as a pivot. The holding member 154 includes a catch 154*a* having a hook-like, retentive shape sized to conform to a contour of the second lockable component 140. The catch 154*a* is oriented relative to a remainder of the latch 150 so as to face generally toward a direction of movement of the latch 150 as it moves away from the disengaged position D and toward the engaged position E. Such direction may be referred to as an engagement direction or as an engagement handedness of the latch 150. The holding member 154 also includes a fore and an aft strike surface 154*b*, 154*c* also generally facing the engagement direction yet disposed opposite one another relative to the catch 154*a* and shaped so as to converge, or lead, into the catch 154*a*. Stated otherwise, the fore strike surface 154*b* extends inwardly relative to the catch 154*a* as it extends nearer to the pivot 152, whereas the aft strike surface 154*c* extends inwardly relative to the catch 154*a* as it extends farther from the pivot 152. In this embodiment, the latch 150 also includes a track 156 spaced radially away from the pivot 152 and having an elongated surface 156*a* oriented relative to a remainder of the latch 150 so as to face generally opposite the engagement direction, i.e., toward the holding member 154. The elongated surface 156*a* extends between a fore end 156*b* and an aft end 156*c* of the track 156 respectively located fore and aft relative to the catch 154*a*.

The latch 150 is biased toward the engaged position E by way of a biasing means of the first component 130, in this case provided in the form of a spring 134. The spring 134 connects the bracket 132 to a connector 152*a* of the latch 150 spaced radially away from the pivot 152 and spaced angularly relative to the holding member 154. As such, an external force sufficient to overcome a biasing force exerted by the spring 134 may urge the latch 150 to pivot toward the disengaged position D. To this effect, the wire 124*a* of the input transmission means 124 of the actuator 120 connects to another connector 152*b* of the latch 150 spaced radially away from the pivot 152 and angularly relative to the holding member 154. The external force results from a relative movement between the movable wire 124*b* of the input transmission means 124 attached to the connector 152*b* of the latch 150, and an end of the sheath 124*b* held stationary relative to the bracket 132. The connectors 152*a*, 152*b* of the latch 150 are each located on arm-like members of the latch 150 respectively cantilevered relative to the holding member 154, although other shapes are contemplated for the portions of the latch 150, provided that they enable a suitable positioning of the connectors 152*a*, 152*b* relative to the pivot 152. In some such implementations, the locking mechanism 110 is arranged such that the biasing means 134 and the input transmission means 124 connect to either side of a same portion of the latch 150 opposite one another.

In the disengaged state of the locking mechanism 110, the actuator 120 exerts such external force sufficient for overcoming the biasing force and effectively holding the latch 150 in the disengaged position D. In the engageable state of the locking mechanism 110, any force exerted by the actuator 120 is insufficient to overcome the biasing force exerted by the biasing means 134, resulting in the latch 150 being forced away from the disengaged position D and, provided that the holdable member 142 is suitably positioned relative to the holding member 154, into the engaged position E. The locking mechanism 110 may be said to be configured to default into the engageable state. Indeed, no external force is required for the locking mechanism 110 to be configured in the engageable state, and the wire 124*a* is arranged such that no external force sufficient to overcome the biasing force may be exerted thereto other than via the input device 122. The selective input means 126 may be arranged such that it may not shorten the effective length of the wire 124*a* past a certain value. Should the wire 124*a* become loose, detached or otherwise unable to convey force from the input device 122, the locking mechanism 110 would thus remain in the engageable state.

Alternate implementations of the movement stopping system 100 are contemplated. In some such implementations, the locking mechanism 110 is configured to default in the disengaged state. To wit, the latch 150 is biased toward the disengaged position, for example under a latch-biasing force exerted by a latch-biasing means of the first lockable component 130 suitably connected to the latch 150. The actuator 120 has a respective input-biasing means arranged to exert an actuator-biasing force to bias the input device 122 away from its second position toward its first position. The input device 122 is operatively connected to the latch 150 via the input transmission means 124 such that as the input device 122 moves away from its second position to its first position, the input device 122 exerts, albeit indirectly, an actuation force of a magnitude sufficient for urging the latch 150 away from the disengaged position and into the engaged position. Hence, the actuator-biasing force may be said to be sufficient for overcoming the latch-biasing force. Exertion of the rated force F1 onto the input device 122 urges the input device 122 away from its first position to its second position, overcoming the actuator-biasing force and rendering, via the input transmission means 124, any actuation force exerted onto the latch 150 insufficient to overcome the latch-biasing force.

It should be understood that the locking mechanism 110 is sized and arranged relative to the kinematics of the mobile elements of the chair 10 to which it is mounted. In particular, as the seat 30 moves across a range of positions of the gliding movement defined between a fore seat position and an aft seat position (FIGS. 3 and 4), the first lockable component 130 and the second lockable component 140 move relative to one another across a range of following positions of a following movement defined between a first following position and a second following position. Conversely, as the seat 30 reciprocates between the fore and aft seat positions, the first lockable component 130 and the second lockable component 140 reciprocate between the first and second following positions. In FIG. 2, the first and the second following positions are depicted as those of a fixedly mounted element of the second lockable component 140 relative to a fixedly mounted element of the first lockable component 130, in this case fore F and aft A positions of the holdable member 142 relative to the bracket 132. Upon the seat 30 being in the rated seat position, the locking mechanism is in a lockable position L of the range of following positions, also depicted as a corresponding position of the holdable member 142 relative to the bracket 132.

The locking mechanism 110 is thus arranged such that a clearance path extending between the fore and aft positions F, A is available for the second lockable member 140 to travel unhindered by either the latch 150 or the first lockable component 130 upon the locking mechanism 110 being in the disengaged state. In this embodiment, the clearance path is circumscribed in part by the track 156 and open on a side facing away from the elongated track surface 156*a* and generally toward the holding member 154. Either one or both of the fore and aft ends 156*b*, 156*c* of the track 156 may, in some embodiments, act as a stop to prevent any following movement of the second lockable member 140 relative to the first lockable member 130 past the range of following positions and, conversely, to prevent any gliding movement of the seat 30 relative to the base 20 past the range of gliding seat positions. The track 156 may however be omitted from certain implementations of the latch 150, in which the clearance path is nonetheless present, the clearance path being defined by the fore and aft strike surfaces 154*b*, 154*c* and by a gap located therebetween next to the catch 154*a*.

Further, the locking mechanism 110 is arranged such that an engagement path defined between the disengaged position D and the engaged position E is available for the latch 150 (and thus the holding member 154) to travel unhindered by neither of the first and the second lockable members 130, 140 in the lockable position L. In this embodiment, the engagement path has opposite ends with one being circumscribed by the catch 154*a* and the other in open communication with the clearance path. The lockable position L corresponds to a position of the locking mechanism 110 in which the latch 150 is operative relative to the first and second components 130, 140 provided that the locking mechanism 110 is in the engageable state. Positions between the fore position F and the aft position A other than the lockable position L correspond to positions of the locking mechanism 110 in which the holding member 154 may slidably engage the holdable member 142. Upon the locking mechanism 110 being in the disengaged state and in a position either fore or aft of the lockable position L, configuring the locking mechanism 110 in the engageable state causes the holding member 154 to strike a corresponding strike surface 154*b*, 154*c* of the holdable member 142 to become slidably engaged therewith and to remain as such until the locking mechanism 110 is brought into the lockable position L or configured in the disengaged state.

The clearance and engagement paths may be said to define a clearance amplitude and an engagement amplitude of the locking mechanism 110. In the present embodiment, the engagement amplitude is less than the clearance amplitude, yet is greater than a portion of the clearance amplitude defined between the fore position F and the lockable position L. Nevertheless, the locking mechanism 110 is arranged such that biasing the latch 150 from the disengaged position D to the engaged position E is quicker than the time typically required for the locking system 110 to move from the fore position F to the lockable position L. This arrangement may advantageously enable stoppage of the gliding movement upon a user attempting to egress from the chair 10 as the seat 30 glides into the fore seat position without the seat 30 gliding back rearward of the rated seat position. Conversely, the locking system 110 is arranged such that biasing the latch 150 from the disengaged position D to the engaged position E is quicker than the time typically required for the locking system 110 to move from the aft position A to the lockable position L. It should also be noted that several elements of the mobile chair system 1 are strategically arranged with respect to one another so as to desirably reduce any delay in stopping the gliding movement following actuation of the locking mechanism 110. For instance, the location at which the second lockable member 140 is mounted to the gliding linkage 42 is determined such that the clearance amplitude is significantly less than that of the gliding movement amplitude of the seat deck 60, and so as to minimize the engagement amplitude, i.e., the maximum distance which the latch 150 may need to travel before the gliding movement is stopped.

In some implementations, at least one component of the locking mechanism 110 is adjustable so as to selectively alter the lockable position L and, indirectly and consequently, alter the rated seat position. For example, in some such implementations, the first and second lockable components 130, 140 are adapted to be repositioned relative to their respective mobile element such that the locking mechanism 110 may hinder the following movement at another locking position of the range of following positions. In other such implementations, at least a portion of the latch 150 is movable or interchangeable so as to reposition the engagement path relative to the clearance path either closer to the fore following position F or closer to the aft following position A. For example, a second latch 150' may be provided with its catch 154*a* located either closer to its pivot 152 such that its lockable position L is closer to the aft position A, or further away from its pivot 152 such that its lockable position L is closer to the fore position F, in comparison to what is shown on FIG. 2 with respect to the latch 150.

In some implementations, the locking mechanism 110 is of an electromechanical type. The actuator 120 is suitably arranged for sending a signal indicative of a force borne by the input device 122 to a controller of the locking mechanism 110 for controllably configuring the locking mechanism 110 in either the disengaged state or the engageable state.

Figure 2A:
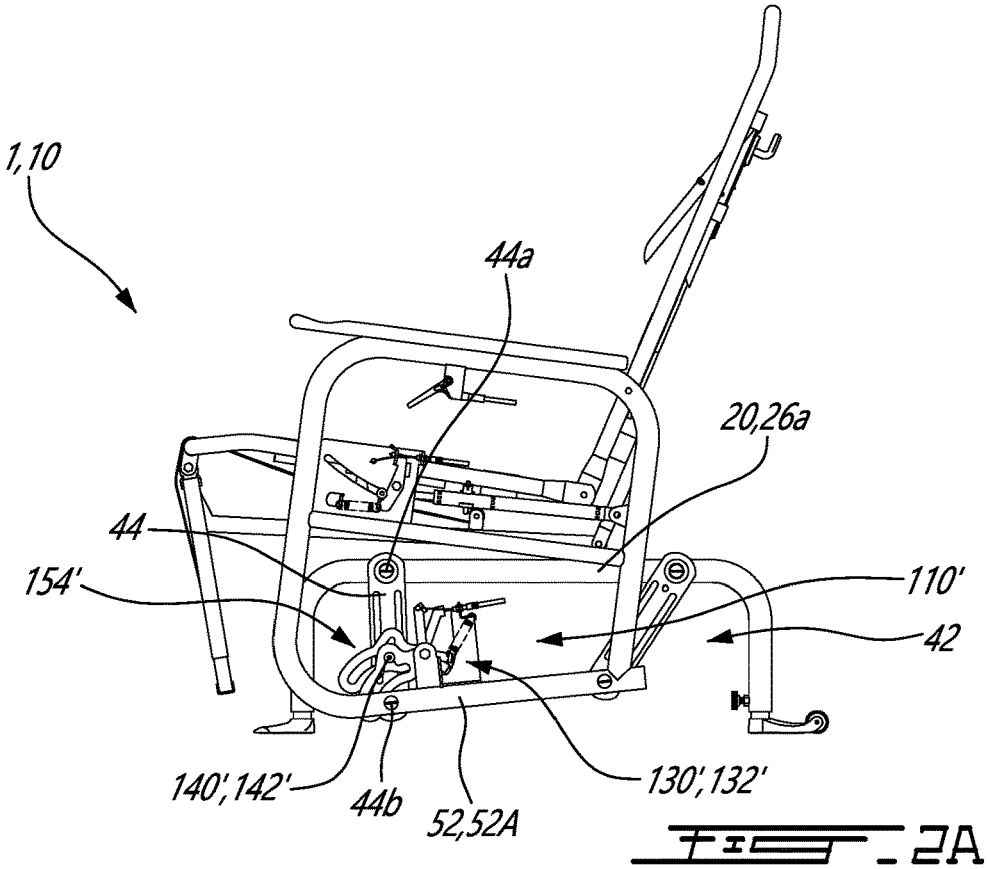
FIG. 2A is left side, cutaway elevation view of another mobile chair system including a movement stopping system having a locking mechanism mounted relative to the seat and to the linkage.
Figure 2B:
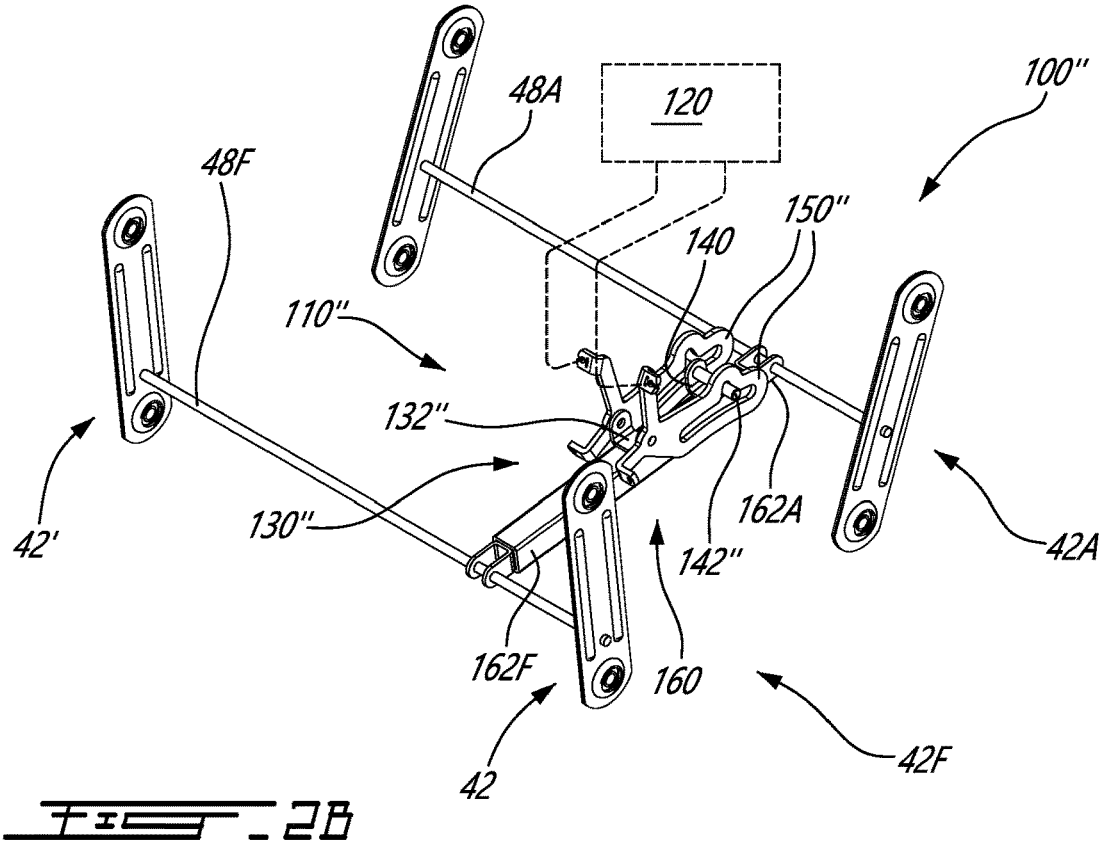
FIG. 2B is a perspective view of a linkage of yet another mobile chair system including a locking mechanism mounted relative to fore and aft links of the linkage.

As will become apparent in view of FIGS. 2A, 2B, several other variations to elements of the movement stopping system 100 are possible, some of which will now be briefly described. Indeed, depending on the implementation, the second lockable member 140 may be mounted to either the fore link 44 or the aft link 46 of the gliding linkage 42. In some such implementations, the first lockable member 130 is mounted to the base 20 and, in other such implementations, to the seat 30. For example, referring to FIG. 2A, the chair 10 can be provided with a movement stopping system 100' according to another exemplary embodiment of the present technology. The movement stopping system 100' comprises a locking mechanism 110' having a first lockable member 130' arranged to be mounted to the seat 30 rather than the base 20, and a second lockable member 140 arranged to be mounted to the fore link 44 proximate the second pivot 44*b* rather than proximate the first pivot 44*a*.

Turning now to FIG. 2B, the chair 10 is provided with a movement stopping system 100" according to yet another embodiment of the present technology. The movement stopping system 100" comprises a locking mechanism 110" having a first lockable member 130" and a second lockable member 140" arranged to be mounted to a respective one of fore and aft linkage assemblies 42F, 42A of the gliding linkage 42, 42'. The first lockable member 130" includes a bracket-like structure 132" connected to the fore linkage assembly 42F and a pair of latches 150" pivotally connected to the bracket 132". The second lockable member 140" includes a peg-like holdable member 142" connected to the aft linkage assembly 42A. In this embodiment, the first and second lockable members 130", 140" are indirectly connected to their corresponding linkage assembly 42F, 42A. Indeed, the locking mechanism includes a sliding joint 160' having a fore sliding member 162F and an aft sliding member 162A respectively connected to fore and aft transverse members 48F, 48A of the linkage assemblies 42F, 42A at one end, and slidably connected to one another at an opposite end. The first and second lockable members 130", 140" are mounted to a respective one of the sliding members 162F, 162A at a location suitable for the locking mechanism 110" to be operable. The locking mechanism 110" arranged as such is located between left and right sides of the gliding linkage 42, 42' and between the fore and aft linkage assemblies 42F, 42A, which may desirably distribute the weight associated thereto and, in some cases, may aid in harmonizing the loads effected to the seat 30 via either sides of the gliding linkage 42, 42' upon interlocking the first and second lockable components 130", 140". The location of the locking mechanism 110" may also benefit applications requiring that space located laterally outward of the gliding linkage 42, 42' be allocated to other purposes.

In some implementations of the movement stopping system 100, the second lockable component 140 includes a bracket-like structure mounted to one of the mobile elements of the chair 10, and the holdable member 142 is movably connected thereto. In some such implementations, the holding member 154 is fixedly mounted to its corresponding mobile element, and the holdable member 142 is movable relative to its bracket between an engaged position (toward which it is biased) and a disengaged position (toward which it must be urged, i.e. forced so as to overcome an opposed, biasing force). The actuator 120 is operatively connected to the holdable member 142 instead of the holding member 152 for configuring the locking mechanism 110 in either the disengaged state or the engageable state.

In some implementations of the movement stopping system 100, a plurality of locking mechanisms 110 are provided for a single chair 10, for example a pair of separate yet simultaneously operable locking mechanisms 110 connected to a sole actuator 120.

Dual Actuation

The mobile chair system 1 may, in some embodiments, be arranged such that stoppage of the gliding movement may occur automatically upon the seat 30 being under loading conditions associated with the reclining movement. In such embodiments, the movement stopping system 100 may be said to be configured for dual actuation. Stated otherwise, such dual actuated movement stopping system 100 is provided with two actuation means for operating a sole locking mechanism 110. The two actuation means may be provided either on a sole actuator or on separate actuators. In the embodiment first shown in FIG. 1, the locking mechanism 110 includes two latches 150, 150', the second latch 150' being actuable independently from the latch 150 (henceforth referred to as the first latch 150) despite being structurally and functionally similar thereto. Indeed, the second latch 150' is laterally offset relative to the first latch 150, and both latches 150, 150' are pivotable relative to the bracket 132 of the first lockable component 130 about a same axis and across a same range of motion. Hence, the second latch 150' is pivotable between corresponding disengaged D' (FIG. 5A) and engaged E' (FIG. 8A) positions, is biased toward its engaged position E' and actuable to be urged into its disengaged position D'. As such, the locking mechanism 110 is configurable with regard to the first latch 150 between a first engageable state in which the first latch 150 is forced toward the engaged position E and a first disengaged state in which the first latch 150 is forced toward the disengaged position D. In addition, the locking mechanism 110 is configurable between a second engageable state in which the second latch 150' is biased toward the engaged position E' and a second disengaged state in which the second latch 150' is forced toward the disengaged position D'. It should be noted that in the above exemplary implementation, the catches 154*a* of the first and second latches 150, 150' are structured so as to correspond to a same lockable position L. In certain other implementations, the second latch 150' could be structured such that its corresponding lockable position L is different than that of the first latch 150. By way of such arrangement, dual actuation may be used to lock the seat 30 either in the rated seat position via the first latch 150 or in another predetermined position via the second latch 150'. This other predetermined position may be referred to as a second rated position, and may correspond to a gliding position of the seat 30 that is either fore or aft of the rated seat position. Details regarding non-limiting examples of dual actuation means will be provided hereinbelow.

With reference to FIGS. 3, 4, 5, 5A and 5B, characteristics pertaining to the gliding and reclining movements of the chair 10 and to related operating principles of the movement stopping system 100 will now be described.

Gliding Movement

Figure 5:
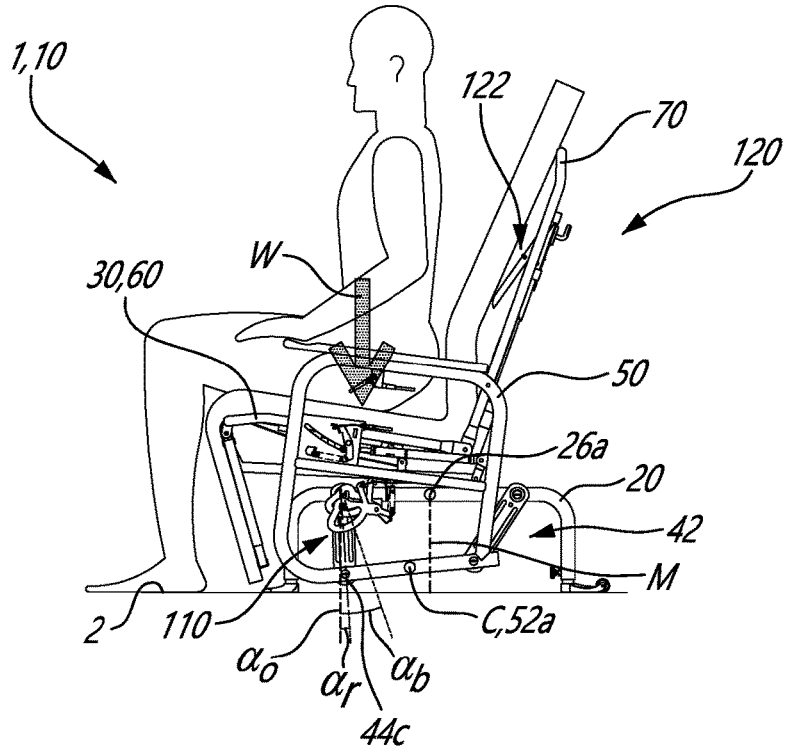
FIG. 5 is a left side elevation view of the mobile chair system of FIG. 1, the seat shown in a rated seat position of the gliding movement located between the baseline seat position and the fore seat position and in which the lockable members are in the lockable position, the locking mechanism shown configured in a first engageable state.
Figure 5A:
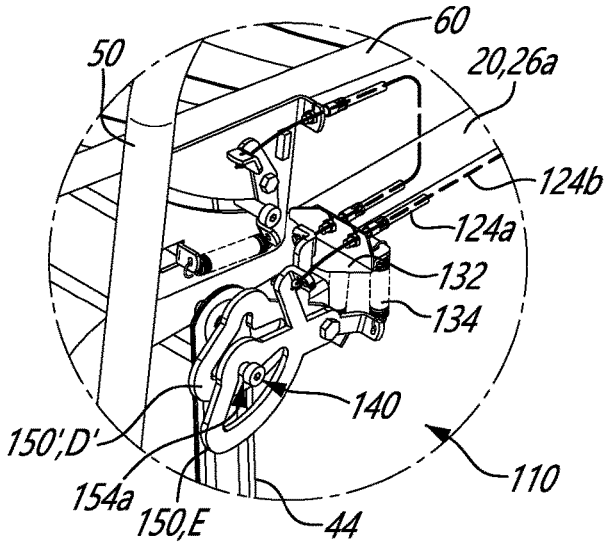
FIG. 5A is a close-up, perspective view of the locking mechanism configured in the first engageable state, with a first latch and a second latch of the locking mechanism shown in an engaged position and a disengaged position respectively.

With reference to FIGS. 3-5, the gliding movement of the mobile chair system 1 typically corresponds to a reciprocating movement, i.e., a movement in which the seat 30 may be moved alternatingly rearwardly from a baseline seat position toward the aft seat position (FIG. 3) and forwardly from the baseline seat position toward the fore seat position (FIG. 4). It should be noted that the baseline seat position is a position toward which the seat 30 is gravitationally biased in absence of substantial load imparted to the seat 30 and provided that the base 20 is level. The gliding movement may be induced by the user seated on the chair 10 imparting a force to the seat 30 toward either of the aft or fore seat positions, for example via an impulsion against the ground surface 2 and/or via a shift of the user's weight along a surface of the seat 30.

The kinematics of the gliding movement are characterized in part by the arrangement of the gliding linkage 42 between the base 20 and the seat 30. In this exemplary implementation of the gliding linkage 42, a bottom portion of the seat frame 50 is coupled to a top portion of the base 20 by the gliding linkage 42 such that the gliding linkage 42 and the seat frame 50 may be said to hang from the base 20 above the ground surface 2. As indicated hereinabove, the fore and aft links 44, 46 of the gliding linkage 42 each have a first connector 44*a*, 46*a*, or first pivot, via which they are pivotally coupled to the base 20. The fore and aft links 44, 46 also have a second connector 44*b*, 46*b*, or second pivot, spaced from their respective first connectors and via which they are pivotally coupled to the seat frame 50.

To aid in understanding the kinematics of the chair 10, the fore, baseline and aft seat positions are schematically represented by way of angles $\alpha_f$, $\alpha_b$, $\alpha_a$ defined by a longitudinal axis 44*c* of the fore link 44 collinear to the fore first and second connectors 44*a*, 44*b* relative to a notional vertical axis $\alpha_o$ of the base 20 intersecting the longitudinal axis 44*c* at the first connector 44*a*.

In the baseline seat position, the fore link 44 is pivoted about its fore first connector 44*a* at a baseline angle $\alpha_b$. The baseline angle $\alpha_b$ is rearward of the vertical axis $\alpha_o$, i.e., counter clockwise when observed from a left-hand side of the chair 10. Upon the seat 30 moving from the aft seat position to the fore seat position, the fore link 44 pivots from the aft angle $\alpha_a$ (FIG. 3) to the fore angle $\alpha_f$ (FIG. 4). In this arrangement, the baseline angle $\alpha_b$ is about 20 degrees, and the aft angle $\alpha_a$ is of a magnitude greater than that of the fore angle $\alpha_f$.

The base 20 can be said to have a notional base segment extending from the first connector 44*a* of the fore link 44 to that of the aft link 46 (in this case being in alignment with a portion of the generally horizontal support member 26*a*), and a notional midline M bisecting the base segment, i.e., a line equidistant to the fore and aft first connectors 44*a*, 46*a* which, in this case extends generally vertically. Also, the seat 30 can be said to have a notional seat segment extending from the second connector 44*b* of the fore link 44 to that of the aft link 46 (in this case being in alignment with a portion of the bottom frame member 52*a*), having a notional center point C located intermediate the fore and aft second connectors 44*b*, 46*b*.

In this arrangement, a distance between the fore and aft first connectors 44*a*, 46*a* (i.e., a length of the base segment) is greater than a distance between the fore and aft second connectors 44*b*, 46*b* (i.e., a length of the seat segment). In addition, the fore and the aft links 44, 46 are sized such that lengths between their respective first and second connectors are substantially the same and are shorter than those of the base segment and of the seat segment.

The chair 10 is arranged such that as the seat 30 moves from the aft seat position to the fore seat position, the center point C moves from an aft center point position to a fore center point position relative to the midline M. Upon the seat 30 being in the baseline seat position, the center point C is at a baseline link distance taken transversely relative to the midline M, which may thus be referred to as a baseline horizontal distance. In exemplary arrangements of the mobile chair system 1, the baseline seat position may vary based on the location of the center of gravity of the seat 30, taking into account the magnitude and distribution of the loads typically borne by the seat 30 (e.g., weight and/or forces exerted by the user, joint assembly 40 elements, and/or movement stopping system 100 elements), and based on levelling adjustments made to the base 20, among possible factors. As such, the baseline horizontal distance may be within a range of between about 2 cm and 7 cm forward of the midline M.

In FIG. 5, the chair 10 is shown with the seat 30 positioned in the rated seat position between the baseline seat position and the fore seat position (FIG. 4). The mobile chair system 1 is arranged such that the rated seat position corresponds to a position toward which the seat 30 converges over time upon the seat 30 bearing no substantial external load other than a rated weight. Stated otherwise, the seat 30 settles into the rated seat position upon being free to move as it supports the rated weight. Schematically represented by vector W, the rated weight is a weight corresponding to a mass within a range of between 36 kg and 205 kg (i.e., a rated mass) supported on the seat 30. Distribution and magnitude of the rated weight W are representative of a user having a corporal mass within the rated mass range being supported by the seat 30. The chair 10 may thus be arranged such that the rated seat position renders the chair 10 ergonomically suitable for ingress and egress based on the corporal mass of the intended users. Conversely, the movement stopping system 100 may advantageously be arranged such that the lockable position L is attained upon the seat 30 attaining the rated seat position. Hence, the lockable position L can also be described as a position into which the locking mechanism 110 settles upon the seat 30 bearing the rated load. In this arrangement, in the rated seat position, the fore link 44 is pivoted at a rated angle $\alpha_r$ corresponding to between 5% and 35% of the baseline angle $\alpha_b$, ±10 degrees. In some implementations, the rated seat position is the position of the seat 30 obtained upon pivoting the fore link 44 to an angle reduced from the baseline angle $\alpha_b$ by between 5 degrees and 20 degrees. In some implementations, the locking mechanism 110 is adjustable to alter the rated seat position within a range of seat positions corresponding to a range of angles of the fore link 44 spanning about ±10 degrees (i.e., 10 degrees clockwise and counter clockwise) from the rated angle $\alpha_r$. Further, upon the seat 30 being in the rated seat position, the center point C is in a rated center point position located between the aft and fore center point positions. The rated center point position is at a rated link distance taken transversely from the midline M (i.e., a rated horizontal distance) corresponding to between 15% and 51% of the distance between the fore and aft first connectors 44*a*, 46*a*.

Figure 5B:
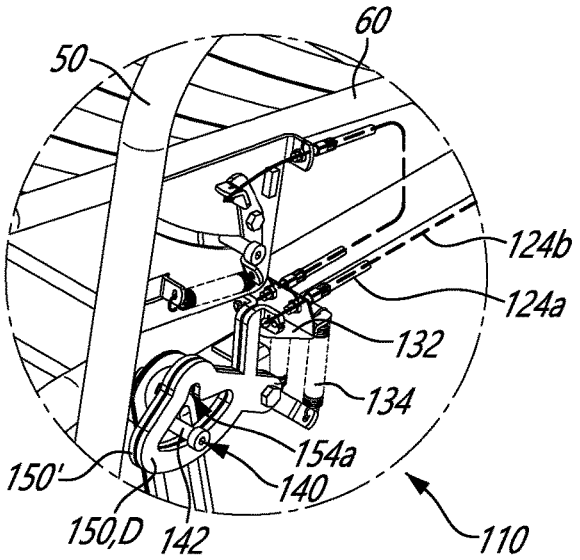
FIG. 5B is a close-up, perspective view of the locking mechanism configured in the disengaged state, with the first and second latches of the locking mechanism positioned in respective disengaged positions.

As best seen in FIG. 5, the gliding movement of the chair 10 may be brought to a stop while the user exerts the rated weight W onto the seat 30. Indeed, the user may adopt a position in which the seat 30 is in the rated seat position and force exerted against the input device 122, if any, is less than the rated force F1. Such balance may be achieved with or without the user making contact with the backrest 70 or the ground surface 2. Under such operating conditions, the locking mechanism 110 is configured in the engageable state and the latch 150 held in the engaged position E, thereby hindering the gliding movement. Thus, the rated force F1 may be determined to represent a threshold force below which a force borne by the first input device 122 is indicative of the user ingressing to or egressing from the chair 10. Indeed, the rated force F1 may be of a magnitude that is less than that of the rated weight. The user may egress from the chair 10 by propping themselves up via the armrests 52*c*. Alternatively, the user may resume gliding by leaning back against the backrest 70 to actuate the input device 122 up to the rated force F1, thereby configuring the locking mechanism 110 in the disengaged state and thus urging the latch 150 away from the engaged position E (FIG. 5A) and into the disengaged position D (FIG. 5B). In some implementations, an auxiliary input device may be mounted to one or both of the armrests 52*c* and be arranged to configure the locking mechanism 110 in the engageable state upon bearing another rated force, i.e., another threshold force above which a force borne by the auxiliary input device is indicative of the user attempting ingress to or egress from the chair 10.

Figure 7:
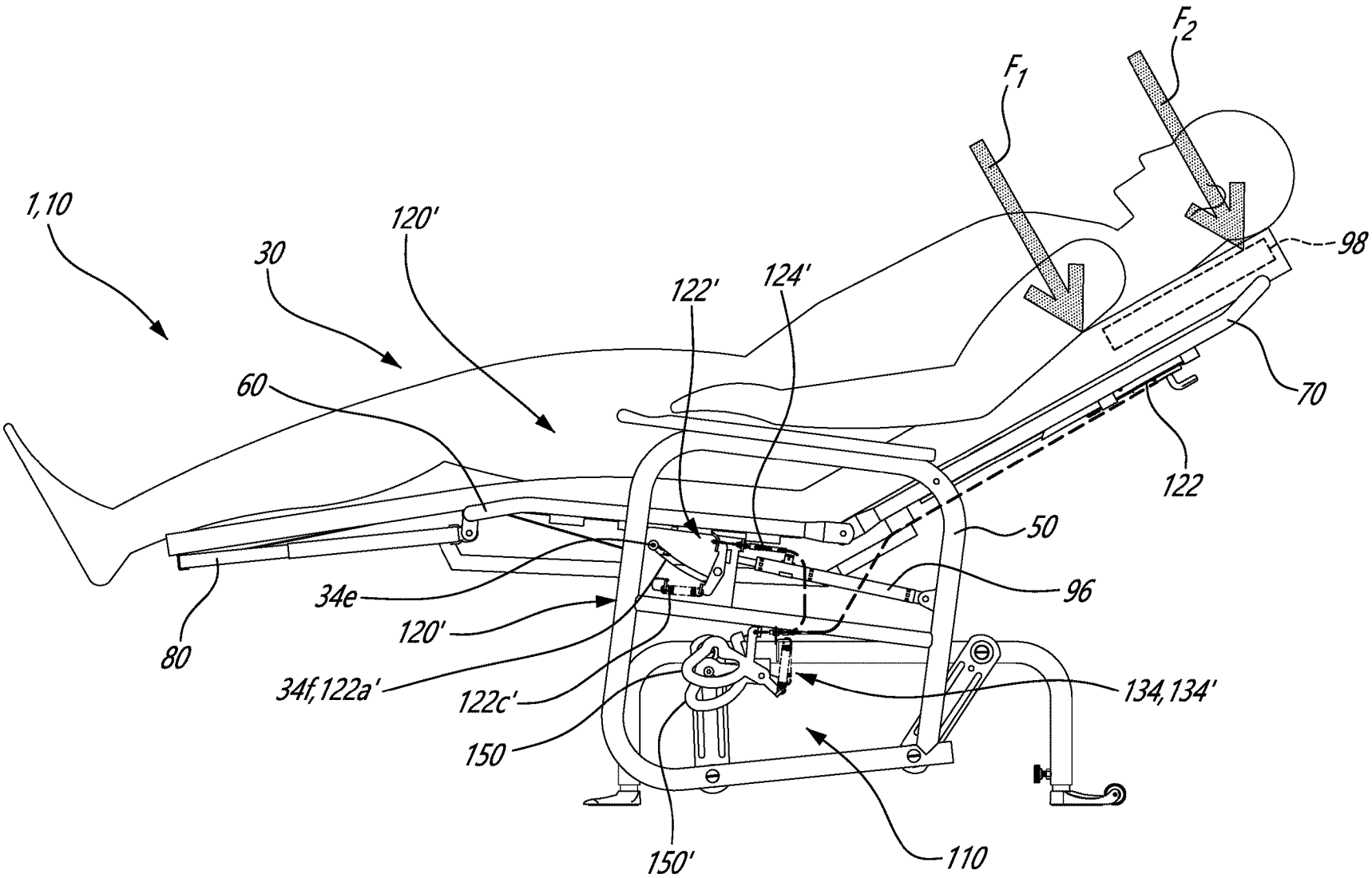
FIG. 7 is a left side elevation view of the mobile chair system of FIG. 1, the seat shown in the resting position and the locking mechanism shown in a second engageable state.
Figure 8A:
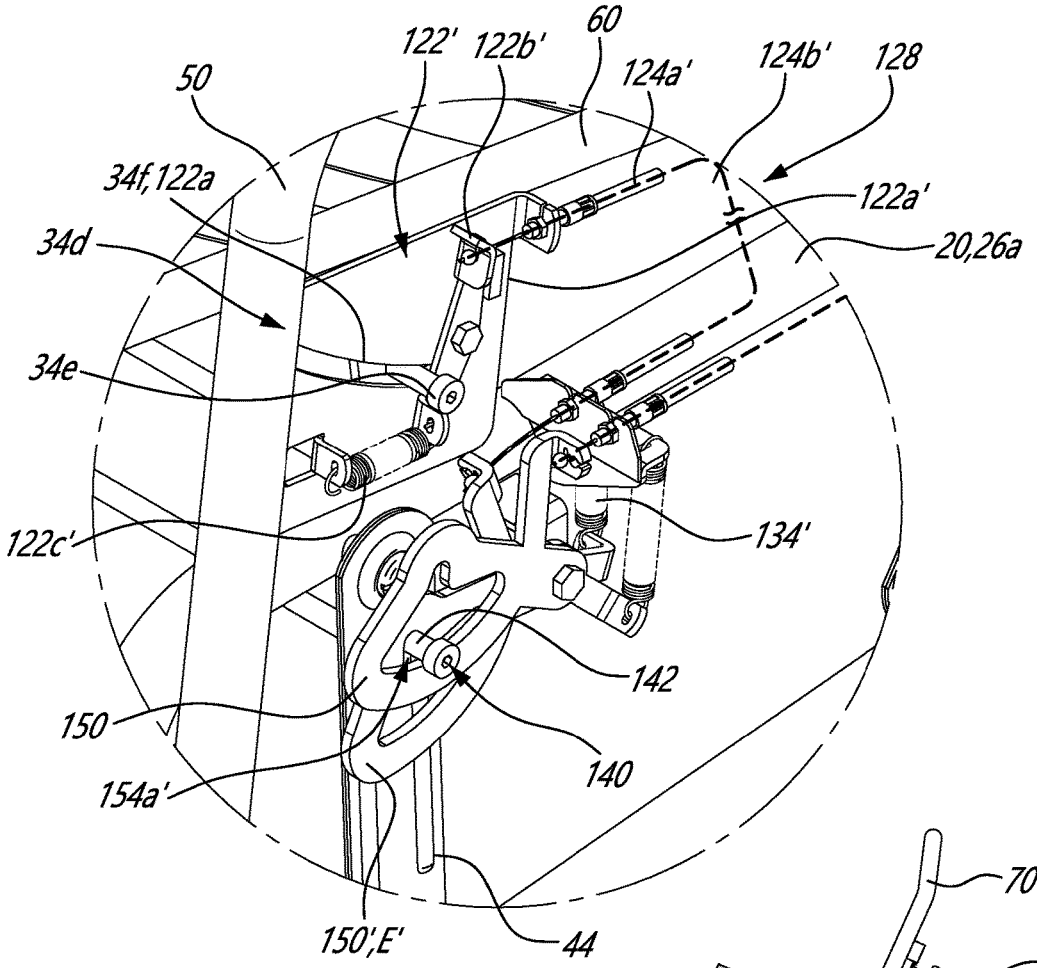
FIG. 8A is a close-up, perspective view of the locking mechanism of FIG. 8.
Figure 8:
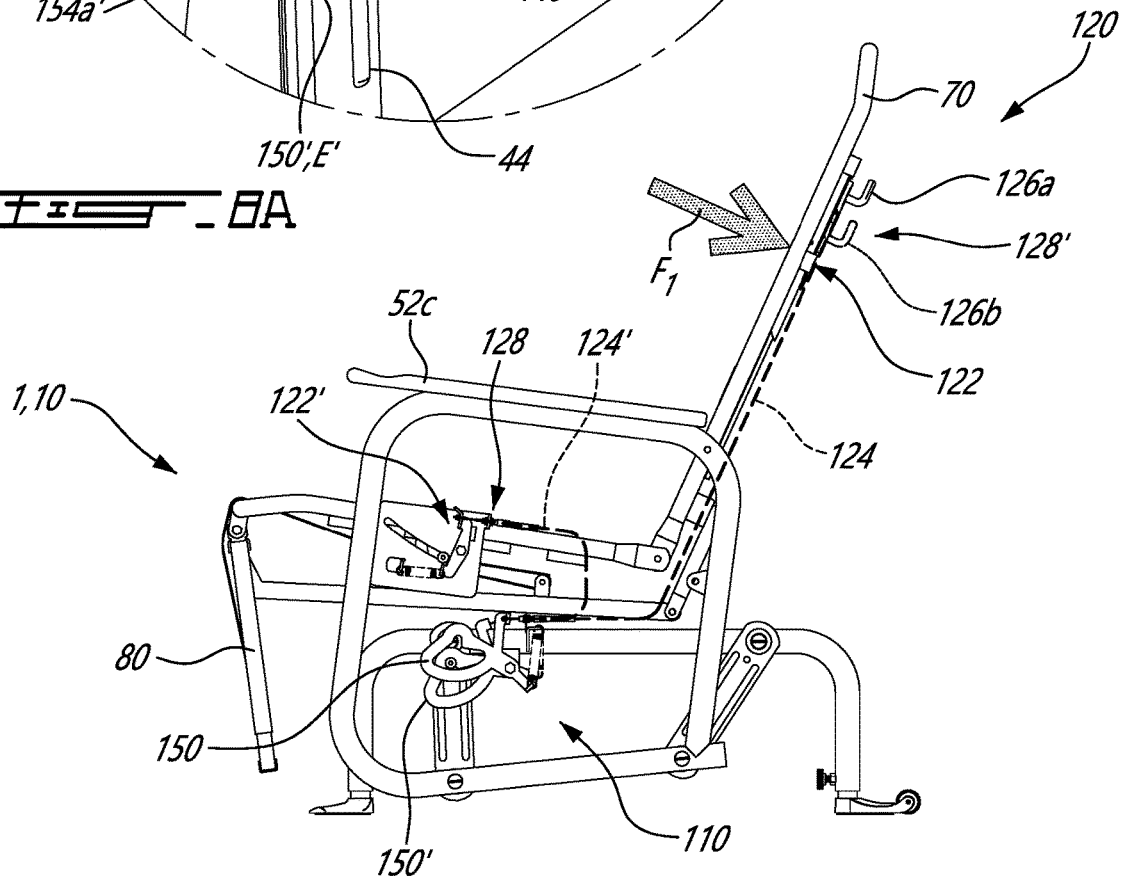
FIG. 8 is a left side elevation view of the mobile chair system of FIG. 1, the seat shown in the rated seat position and in a sitting position of the reclining movement with the locking mechanism in the second engageable state.

It should be noted that regardless of the locking mechanism 110 being configured in its first engageable state (FIG. 5A) or its first disengaged state (FIG. 5B), the locking mechanism 110 may remain in either of its second disengaged state (FIGS. 5, 5A, 5B) or its second engageable state (FIGS. 7, 8, 8A). Indeed, the second latch 150' is operable by way of a second actuator 120' of the movement stopping system 100 in a manner which, as will be described hereinbelow, is intimately related to operating principles of the reclining movement of the chair 10.

Reclining Movement

Figure 6:
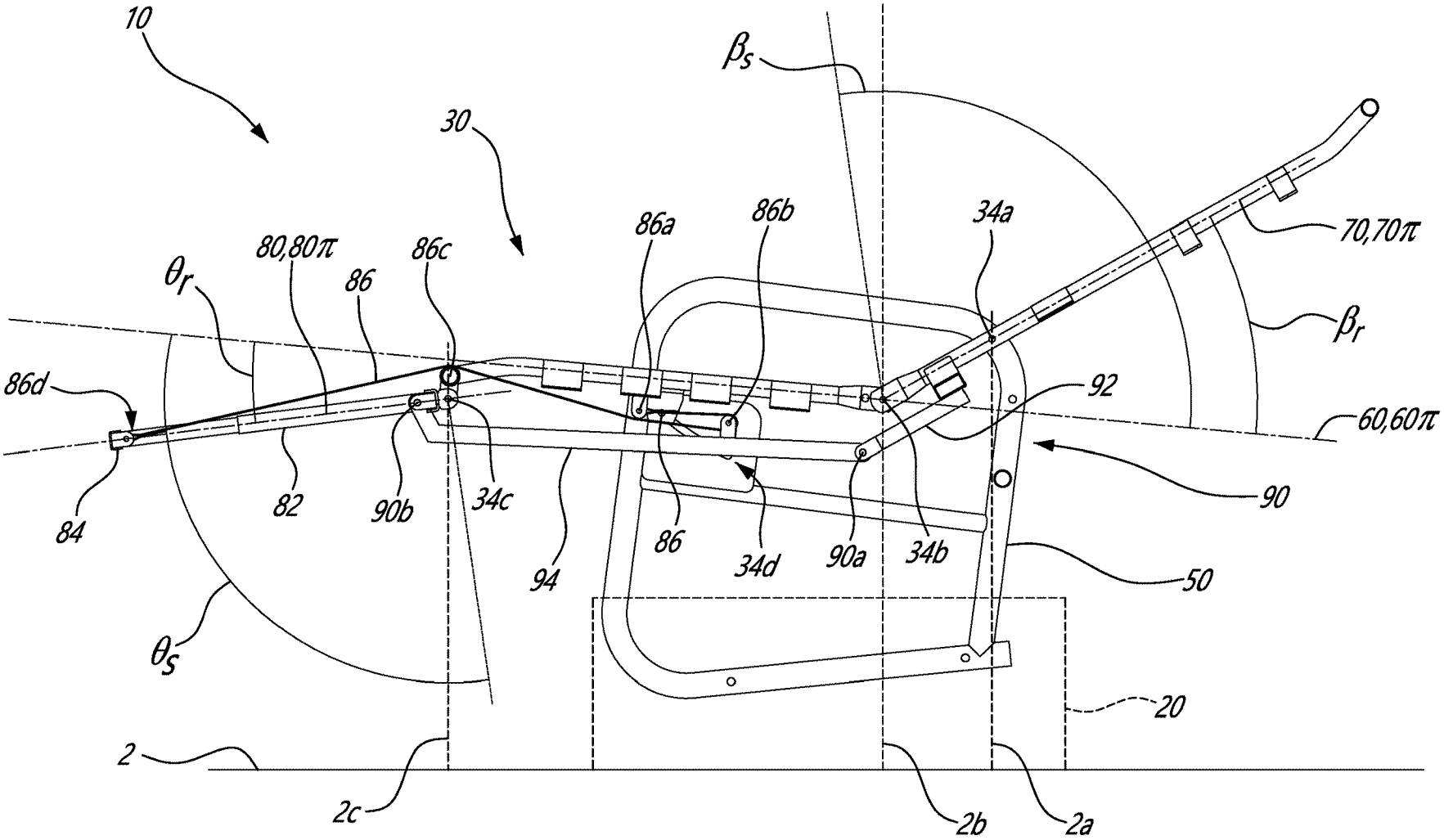
FIG. 6 is a left side elevation view of portions of the mobile chair system of FIG. 1, the seat shown in a resting position of a reclining movement of the seat relative to the base.

Referring to FIG. 6, the reclining movement of the chair system 1 will now be described in greater detail. The reclining movement generally corresponds to a movement in which the seat 30 is movable between a sitting position and a resting position such that at least one resting module of the seat 30, for example the backrest 70 or the legrest 80, is either horizontalized or verticalized relative to the seat deck 60. Indeed, the backrest 70 may be said to be movable relative to the seat deck 60 between a generally transverse/vertical orientation and a generally parallel/horizontal orientation. Likewise, the legrest 80 may be said to be movable relative to the seat deck 60 between a generally transverse/vertical orientation and a generally parallel/horizontal orientation. The seat deck 60, the backrest 70 and the legrest 80 are respectively shown as laying along notional planes, schematically shown at 60π, 70π, 80π, respectively.

In the resting position, the backrest 70 is inclined so as to extend generally rearwardly of the seat deck 60 at a backrest resting angle βr relative to the plane 60π of the seat deck 60. The backrest resting angle βr may be described as an angle at which the backrest 70 is fully reclined, for example 20 degrees. In the resting position, the backrest 70 may be generally horizontal relative to the ground surface 2 and, in some embodiments, be generally parallel to the seat deck 60 (i.e., at a backrest resting angle βr of 0 degree). In the sitting position, the backrest 70 extends generally transversely to the seat deck 60 at a backrest sitting angle βs relative to the plane 60π of the seat deck 60. The backrest sitting angle βs may be described as an angle at which the backrest 70 is fully upright. In the sitting position, the backrest 70 may be generally vertical relative to the ground surface 2 and, in some embodiments, be generally perpendicular to the seat deck 60 (i.e., at a backrest sitting angle βr of 90 degrees). The backrest 70 may be pivotable to a backrest angle within a range of 70 degrees inclusive of the backrest resting and sitting angles βr, βs. A complementary angle between the backrest 70 and the seat deck 60 may be of about 105 degrees and of about 160 degrees upon the backrest 70 being at the backrest sitting angle βs and at the backrest resting angle βr, respectively.

In the resting position, the legrest 80 extends generally forwardly of the seat deck 60 at a legrest resting angle Θr relative to the seat deck 60. The legrest resting angle Θr may be described as an angle at which the legrest 80 is fully deployed. In the resting position, the legrest 80 may be generally horizontal relative to the ground surface 2. In the sitting position, the legrest 80 extends generally downwardly relative to the seat deck 60 at a legrest sitting angle Θs relative to the seat deck 60. The legrest sitting angle Θs may be described as an angle at which the legrest 80 is fully withdrawn. In the sitting position, the legrest 80 may be generally vertical relative to the ground surface 2. The legrest 80 may be pivotable to a legrest angle within a range of 90 degrees inclusive of the legrest resting and sitting angles Θr, Θs.

The kinematics of the reclining movement are defined by joints 34 of the seat 30 connecting its seating elements (i.e., the seat frame 50, the seat deck 60, the backrest 70 and the legrest 80) and by the arrangement of the reclining mechanism 90 relative to such seating elements. A first joint 34*a* of the seat 30 articulates the backrest 70 and the seat frame 50. The first seat joint 34*a* is a pivot for pivoting the backrest 70 relative to the seat frame 50 about an axis located between bottom and top sides of the backrest 70 and on a rear side of the seat frame 50. A second joint 34*b* of the seat 30 articulates the backrest 70 and the seat deck 60. The second seat joint 34*b* is a pivot for pivoting the backrest 70 relative to the seat deck 60 about an axis located proximate the bottom side of the backrest 70 and a rear side of the seat deck 60. A third seat joint 34*c* articulates the seat deck 60 and the legrest 80. The third seat joint 34*c* is a pivot for pivoting the legrest 80 relative to the seat deck 60 about an axis located proximate a top side of the legrest 80 and a front side of the seat deck 60. A fourth seat joint 34*d* articulates the seat deck 60 relative to the seat frame 50. The fourth seat joint 34*d* is located forward of the second seat joint 34*b* and is arranged for sliding the seat deck 60 relative to the seat frame 50. In this exemplary arrangement, the fourth seat joint 34*d* indirectly joins the seat deck 60 to the seat frame 50 via the reclining linkage 90. The reclining linkage 90 includes a rear reclining link 92 connected to the backrest 70 between its bottom and top sides and extends to a first recliner joint 90*a* of the recliner linkage 90. The first recliner joint 90*a* is spaced outwardly from the bottom side of the backrest 70 so as to clear the second seat joint 34*b*. The reclining linkage 90 also includes a front reclining link 94 articulated with the rear link 92 at the first recliner joint 90*a*. The front link 94 is slidably connected to the seat frame 50 via the fourth seat joint 34*d*. As best seen in FIG. 8A, the front seat joint 34*d* is formed by a slider 34*e* affixed to the seat deck 60 disposed beneath its notional plane 60π and slidably connected to a track 34*f* affixed to the seat frame 50.

A second recliner joint 90*b* of the recliner linkage 90 articulates the front recliner link 94 and the legrest 80. The second recliner joint 90*b* is a pivot for pivoting the legrest 80 relative to the seat deck 60 about an axis located proximate a top side of the legrest 80 and the front side of the seat deck 60. In this exemplary arrangement, the reclining linkage 90 connects the backrest 70 to the legrest 80 so as to couple their respective movements to that of the seat deck 60. Upon pivoting the backrest 70 relative to the seat frame 50 so as to position the chair 10 from the sitting position to the resting position, the rear reclining link 92 is pivoted downwardly with the backrest 70 about the first seat joint 34*a*. The first recliner joint 90*a* is displaced forwardly relative to the first seat joint 34*a* as the rear recliner link 92 is pivoted downwardly, causing the front recliner link 94 to be displaced forwardly with the first and second recliner joints 90*a*, 90*b*.

It should be noted that the track 34*f* is arranged so as to induce both a horizontal and a vertical component to the displacement of the seat deck 60 relative to the seat frame 50 upon displacing the slider 34*e* along the track 34*f*. The second recliner joint 90*b* is displaced forwardly relative to the third seat joint 34*c* as the front recliner link 94 is displaced forwardly. The legrest 80 is pivoted upwardly with the second recliner joint 90*b* about the third seat joint 34*c* as the second recliner joint 90*b* is displaced forwardly.

Upon the seat 30 being in the rated seat position, the backrest angle may also be defined relative to a notional line 2*b* normal to the ground surface 2 and aligned with the second seat joint 34*b*. In the resting position, the backrest 70 extends rearwardly and at a rearward angle to the line 2*b*, and may thus be said to be reclined relative to the line 2*b*. In the sitting position, the backrest 70 extends upwardly and generally along the line 2*b*. In some arrangements, in the sitting position, the backrest 70 may be movable so as to extend at a forward angle to the line 2*b*, i.e., the backrest seating angle βs may be canted forward of the line 2*b*. In some arrangements, in the sitting position, the backrest 70 is movable between a range of backrest angles defined between the backrest resting and seating angles βr, βs.

Conversely, upon the seat 30 being in the rated seat position, the legrest angle may also be defined relative to a notional line 2*c* normal to the ground surface 2 and aligned with the third seat joint 34*b*. In the resting position, the legrest 80 extends forwardly from the seat deck 60 and at a forward angle to the line 2*c*, and may thus be said to be deployed relative to the line 2*c*. In the sitting position, the legrest 80 extends downwardly from the seat deck 60 and generally along the line 2*c*. In some arrangements, in the sitting position, the legrest 80 may be movable so as to extend at a rearward angle to the line 2*c*, i.e., the legrest sitting angle Θs may be rearward of the line 2*c*. In some arrangements, in the sitting position, the legrest 80 is movable between a range of legrest angles between the legrest resting and sitting angles Θr, Θs.

The slider 34*e* and the track 34*f* may be positioned elsewhere relative to the seat frame 50 and the seat deck 60 in alternate implementations of the present technology.

Extension Movement

Further, in this arrangement of the chair 10, the legrest 80 is adjustable in length so as to define an extension movement. The legrest 80 has a proximate portion 82 interfacing the seat deck 80 at the third seat joint 34*c* and the front reclining link 94 at the second reclining joint 90*b*. The legrest 80 also includes a distal portion 84 movably joined to the proximate portion 82 so as to be movable from a first legrest position relative to the third seat joint 34*c* to a second legrest position away therefrom so as to increase the length of the legrest 80. Also, the chair 10 further includes a legrest extension mechanism arranged to couple the extension movement to the reclining movement such that the distal portion 84 of the legrest 80 moves between the first and second legrest positions as the seat 30 moves between the sitting and resting positions. For instance, the legrest extension mechanism may have a telescopic construction and include a means for biasing the distal portion 84 of the legrest 80 toward the second position. The legrest extension mechanism may also include a belt 86 arranged relative to the seat 30 so as to be tensioned between the seat deck 60 and the legrest 80. A first segment of the belt 86 may tensioned between the seat frame 50 and the reclining linkage 90 at first and second locations 86*a*, 86*b* of the belt 86. A second segment of the belt 86 may tensioned between the reclining linkage 90 and the seat deck 60 at the second location 86*b* (in this case a pulley-like structure affixed to the front reclining link 94) and at a third location 86*c* of the belt 86. The means for biasing the distal portion 84 of the legrest 80 may be configured so as to maintain a tension in the belt 86 at a tension value greater than a minimum value. The displacement of the front reclining link 94 displaces the second location 86*b* relative to the first location 86*a* to induce a change in length of the different segments of the belt 86 as well as a change in the tension in the belt 86 so as to pull the distal portion 84 of the legrest 80 toward the first legrest position or to release the distal portion 84 for it to be biased back toward the second legrest position.

A third segment of the belt 86 may be tensioned between the seat deck 60 and the distal portion 84 of the legrest 80 at the third location 86*c* and at a fourth location 86*d* of the belt 86. The belt 86 may be arranged such that as the seat 30 moves from the resting position to the sitting position, a distance between the first and second locations 86*a*, 86*b* may increase and a tension in the belt 86 may be induced so as to forcibly move the distal portion 84 of the legrest 80 into the first legrest position.

In some arrangements of the chair 10, the legrest 80 is omitted, although the chair 10 may nevertheless allow a reclining movement in which at least the backrest 70 moves relative to the seat frame 50. In some such arrangements, the reclining linkage 90 is omitted, and the seat deck 60 and the seat frame 50 are directly slidably joined to one another. It is contemplated that in some implementations where the legrest 80 is absent, a stand-alone ottoman (not shown) may be provided for use forward of the seat 30, and the chair 10 may be arranged such that upon the seat 30 being in the resting position, the seat deck 60 is oriented at a desired angle relative to the ottoman.

Actuation Related to the Reclining Movement

Turning now to FIG. 7, the seat 30 is shown in the rated seat position, whereas the locking mechanism 110 is in the lockable position, configured in its first disengaged state (i.e., absent actuation from the first actuator 120) and in its second engageable state (i.e., under actuation from the second actuator 120'). Hence, although the first latch 150 is held in its disengaged position D, the gliding movement is hindered by way of the second latch 150' being in the engaged position E'.

The second actuator 120' includes a second input device 122' operatively connected to the locking mechanism 110 by way of a second input transmission means provided in the form of a cable assembly 124' similar to that of the input transmission means 124 of the first actuator 120. The cable assembly 124' thus includes a wire 124*a*' and a sheath 124*b*'. The wire 124*a*' is slidably received in the sheath 124*b*' and connects to the input device 122' proximate a first end of the sheath 124*b*' held stationary relative to the bracket 122*a*', and to the second latch 150' at a second end of the sheath 124*b*' opposite the first end and held stationary relative to the bracket 132 of the locking mechanism 110.

In the depicted exemplary implementation, the second input device 122' is a trigger-like assembly secured to the seat 30. The second input device 122' includes a bracket 122*a*' mounted to the seat frame 50 proximate the track 34*f* (in this case forming a unitary piece with the track 34*f*), a lever 122*b*' with a first connector pivotally connected to the bracket 122*a*' and a biasing means 122*c*' linking the bracket 122*b*' to a second connector of the lever 122*b*' spaced radially away from the first connector. The lever 122*b*' is pivotable about its first connector between a first position and a second position relative to the bracket 122*a*' and the track 34*f*, and is arranged relative to the biasing means 122*c*' to be biased thereby toward the second position. The wire 124*a*' connects to the lever 122*b*' at a third connector thereof spaced radially from the pivot and angularly away from the biasing means 122*c*'. The wire 124*a*' is arranged to transmit a biasing force exerted by a biasing means 134' (FIG. 8A) of the locking mechanism 110 to the lever 122*b*', such that the biasing means 122*c*', 134' cooperate to subject the lever 122*b*' to a total biasing force which must be overcome to bring the lever 122*b*' in the first position. The lever 122*b*' is arranged so as to extend across the track 34*f* in either position between the first and second positions, and to engage with the slider 34*e* so as to be urged toward the first position thereby upon the seat 30 moving into the sitting position. The lever 122*b*' is also arranged to be biased into the second position unhindered by the slider 34*e* upon the seat 30 being in the resting position. As the seat 30 moves from the sitting position to the resting position, the slider 34*e* moves with the seat deck 60 along the track 34*f* away from the lever 122*b*', allowing the biasing means 122*c*' to move the lever 122*b*' toward the second position.

In this implementation, the locking mechanism 110 is configurable via two resting modules. Indeed, operation of the locking mechanism 110 in the second engageable state is coupled to the backrest 70 and the legrest 80 being respectively at the backrest and legrest resting angles βr, Θr relative to the seat deck 60. In other implementations, the locking mechanism 110 is configurable via a sole resting module of the seat 30. In some implementations, the locking mechanism 110 is configurable to operate in the second engageable state upon the at least one resting module being at a threshold module angle relative to the seat deck 60. For instance, the backrest 70 may be adjustable within a range of backrest angles from the backrest seating angle βs toward the backrest resting angle βr up to the threshold module angle for ergonomics considerations without hindering the gliding movement, and to past the threshold module angle to hinder the gliding movement.

Furthermore, in FIG. 7, locking mechanism 110 is shown in the second selectively engageable state, and the seat 30 is shown locked in the resting position, held in place by a reclining locking mechanism of the movement stopping system 100. The reclining locking mechanism includes a sliding assembly 96 having two portions slidable relative to one another and respectively connected to the seat frame 50 and the seat deck 60, and another input device 98, herein referred to as a third input device, mounted to a resting module of the seat 30 and operatively connected to the sliding assembly 96. The sliding assembly 96 in this case includes telescopically connected members and a mechanical stopping mechanism provided for selectively holding the members in place relative to one another. The sliding assembly 96 is operable in either a moving state so as to allow its members to slide relative to one another, or in an static state so as to hold its members in a given position. In the static state, the sliding assembly 96 binds the reclining linkage 90 and thereby hinders the reclining movement of the chair 10. In the moving state, the user may induce movement of the seat 30 toward the resting position by leaning rearward into the backrest 70, thereby forcing the seat deck 60 forwardly relative to the seat frame 50 and thus lengthening the telescopic members of the sliding assembly 96 as it follows the movement of the seat deck 60. Conversely, the user may induce movement of the seat 30 toward the sitting position by leaning forward and away from the backrest 70, thereby forcing the seat deck 60 rearwardly relative to the seat frame 50 and thus shortening the sliding assembly 96. In this embodiment, the sliding assembly 96 is biased in the static state, that is, the reclining movement of the chair 10 is prevented unless the third input device 98 is operative. The third input device 98 is arranged to be operative upon being imparted with a second rated force (schematically shown by vector F2) via the resting module. In this exemplary arrangement, the input device 98 is a pressure sensor and the resting module is a headrest portion of the backrest 70 located upward of the input device 122. The second rated force F2 may for example be of a magnitude greater than that typically applied by the user on the third input device 98 during the gliding movement. In some implementations, the third input device 98 is arranged to be calibrated such that the second rated force F2 is of a magnitude determined for a specific user. In alternate implementations, the sliding assembly 96 may be an electromagnetic linear actuator. The third input device 98 may be provided in the form of a controller, for example disposed proximate one of the armrests 52*c*, having switches and/or buttons for controlling the sliding assembly 96 to selectively move the seat 30 into a desired reclining position. At least another resting module or portion thereof, e.g., one of the legrest 80, one or both armrests 52*c* or another portion of the backrest 70, may be provided with a fourth input device. In some such implementations, the third input device 98 may be used to controllably move the seat 30 toward the resting position, whereas the fourth input device may be used to controllably move the seat 30 toward the sitting position. Other arrangements for the reclining locking mechanism are possible. In some implementations of the self-stopping mobile chair system 1, the reclining locking mechanism may be omitted.

Override Means

With reference to FIGS. 8 and 8A, it should be noted that in some implementations, the locking mechanism 110 is configurable in the second engageable state despite the seat 30 being in the sitting position. Indeed, the second input means 122' can be selectively rendered inoperative by way of a selective input override means 128 (not shown in detail) mounted to the seat 30 and arranged for selectively altering an input otherwise transmissible from the input device 122' to the locking mechanism 110. For example, the selective override means 128 may be a hand-operable mechanism interfacing between the input device 122' and the cable assembly 124' such that it may be used to selectively lengthen or shorten an effective length of the wire 124*a*'. Increasing the effective length past a certain value may thus render the locking mechanism 110 inoperable by way of the input device 122'. The selective override means 128 may include a lever disposed proximate the seat deck 60. The selective override means 128 may correspond to the auxiliary input device described hereinabove. In some implementations, the selective override means 128 is operable via one or both of the armrests 52*c*, for example by the user attempting ingress to or egress from the chair 10, or by a caregiver or other bystander assisting the user.

In other implementations, an actuator of the movement stopping system 100 is provided with an automatic input override means 128' arranged relative to its input transmission means. As schematically shown in FIG. 8 with respect to the first actuator 120, the automatic input override means 128' may be a sliding mechanism via which the wire 124*a* of the input transmission means 124 connects to the input device 122. In such implementations, the sliding mechanism is arranged to be slidable relative to the input device 122 with the wire 124*a* to render the effective length of the wire 124*a* greater upon the seat 30 being in the resting position than in the sitting position such that moving the seat 30 into the resting position automatically configures the locking mechanism 110 in the first engageable state. In some such implementations, the selective input means 126 is mounted to the sliding mechanism so as to be slid with the end of the wire 124*a* attached thereto between a remote position 126*a* and a proximate position 126*b* as the seat 30 moves between the sitting position and the resting position. Hence, the first actuator 120 may be said to be arranged for dual actuation, i.e., for actuation of the locking mechanism 110 with respect to either of the gliding movement and the reclining movement of the chair 10. In certain like implementations, the second latch 150' and the second actuator 120' may be omitted.

Although the present technology has been described in the context of a mobile chair of a type provided for gliding and for reclining movements, it is understood that it could also be used in the context of other mobile chairs, such as chairs of a type provided solely for gliding or for reclining, wheel chairs, or even adapted for use with motorized vehicle seating. The term chair is understood herein to mean any type of mobile seating.

The above description is meant to be exemplary only, and one skilled in the art will recognize that changes may be made to the embodiments described without departing from the scope of the technology disclosed. Still other modifications which fall within the scope of the present technology will be apparent to those skilled in the art, in light of a review of this disclosure, and such modifications are intended to fall within the appended claims.

The invention claimed is:

1. A movement stopping system for a mobile chair including a base, a joint assembly and a seat kinematically coupled to the base via the joint assembly to allow a movement of the seat relative to the base between a fore seat position and an aft seat position, the movement stopping system comprising:

a locking mechanism including a pair of lockable components adapted to be mountable to the chair and a latch movably connected to a first component of the lockable components to be movable relative to a second component of the lockable components between a disengaged position and an engaged position, the latch biased toward the engaged position and actuable toward the disengaged position, the lockable components being movable relative to one another between a first following position and a second following position of a range of following positions, and the second lockable component being caught by the latch upon the latch moving into the engaged position with the lockable components being at a lockable position of the range of following positions, the latch being clear of the second component when in the disengaged position, and an actuator operatively connected to the latch and operable to urge the latch into the disengaged position, wherein the latch is a first latch of the locking mechanism and the actuator is a first actuator of the movement hindering system, the locking mechanism including a second latch movably connected to the first component to be movable relative to the second component between a respective disengaged position and a respective engaged position, biased toward the respective engaged position and actuable toward the respective disengaged position, the second latch interlocking the lockable components at a respective lockable position of the range of following positions when in the respective engaged position, the second latch being clear of the second component when in the respective disengaged position, and the movement stopping system including a second actuator operatively connected to the second latch and configured to be operable via the seat such that the first latch and the second latch are actuable independently.

2. A self-stopping mobile chair system comprising:

a chair including a base, a joint assembly and a seat kinematically coupled to the base via the joint assembly to allow a movement of the seat relative to the base between a fore seat position and an aft seat position;

a locking mechanism configurable between:

an engageable state in which the locking mechanism locks the seat so as to hinder the movement upon the seat being in a rated seat position between the fore and aft seat positions, the seat movable toward the rated seat position to be locked by the locking mechanism, and a disengaged state in which the seat is movable between the fore and aft seat positions unhindered by the locking mechanism; and an actuator operatively connected between the seat and the locking mechanism so as to configure the locking mechanism either in the disengaged state upon the seat bearing a rated force or in the engageable state absent the rated force;

wherein the seat includes a seat deck facing away from the base and the joint assembly, the seat settling into the rated seat position upon a sole external force exerted against the seat being a rated weight borne by the seat deck and into a baseline seat position rearward of the rated seat position absent external force.

3. The mobile chair system of claim 2, wherein the rated force is of a magnitude less than that of the rated weight.

4. The mobile chair system of claim 2, wherein the seat includes a resting module adjacent to the seat deck, the resting module movable relative to the seat deck between a sitting module angle and a resting module angle greater than the sitting module angle, the engageable state being a first engageable state and the locking mechanism being configured in a second engageable state in which, upon the seat bearing the rated force and the resting module being at a threshold module angle between the sitting module angle and the resting module angle, the locking mechanism locks the seat.

5. The mobile chair system of claim 4, wherein the disengaged state is a first disengaged state, the locking mechanism being configured in a second disengaged state in which, upon the seat bearing the rated force and the resting module being at an angle between the sitting module angle and the threshold module angle, the seat is movable between the fore and aft seat positions unhindered by the locking mechanism.

6. The mobile chair system of claim 4, wherein the actuator is a first actuator and the rated force is a first rated force, the mobile chair system comprising a second actuator operatively connected between the seat and the locking mechanism so as to configure the locking mechanism in the second engageable state upon the seat bearing a second rated force.

7. The mobile chair system of claim 2, wherein the joint assembly includes a gliding linkage including a link having a first connector pivotally joined to the base and a second connector spaced from the first connector and pivotally joined to the seat, the link pivoting about the first connector and relative to a vertical orientation of the base from a baseline link angle to a rated link angle as the seat moves from the baseline seat position to the rated seat position, the rated link angle being less than the baseline link angle.

8. The mobile chair system of claim 7, wherein the rated link angle is between 5% and 35% of the baseline link angle.

9. The mobile chair system of claim 7, wherein the link is a fore link and the first and second connectors are fore first and second connectors, the gliding linkage including an aft link rearward of the fore link, the aft link having an aft first connector pivotally joined to the base rearward of the fore first connector and an aft second connector spaced from the aft first connector and pivotally joined to the seat, a horizontal distance between the fore second connector and a point intermediate the fore and aft first connectors increases from a baseline link distance to a rated link distance as the seat moves from the baseline seat position to the rated seat position.

10. The mobile chair system of claim 9, wherein the rated link distance is between 15% and 51% of a distance between the fore first connector and the aft first connector.

11. The mobile chair system of claim 1, wherein the locking mechanism includes a pair of lockable components and a latch movably connected to a first component of the lockable components to be movable relative to a second component of the lockable components between a disengaged position and an engaged position, the latch biased toward the engaged position and actuable toward the disengaged position.

12. The mobile chair system of claim 11, wherein the latch has a latch connector pivotally connected to the first component and a retentive shape defined at a location spaced radially away from the latch connector, the retentive shape arranged to engage with the second component upon the locking mechanism being in the engageable state and the seat being in the rated seat position.

13. The mobile chair system of claim 11, wherein the second lockable component is affixed to a link of the joint assembly being pivotally connected to the base and to the seat and the first lockable component is affixed to one of the base and the seat.

14. A self-stopping mobile chair system comprising:

a chair including a base, a joint assembly and a seat kinematically coupled to the base via the joint assembly to allow a movement of the seat relative to the base between a fore seat position and an aft seat position;

a locking mechanism configurable between:

an engageable state in which the locking mechanism locks the seat so as to hinder the movement upon the seat being in a rated seat position between the fore and aft seat positions, the seat movable toward the rated seat position to be locked by the locking mechanism, and a disengaged state in which the seat is movable between the fore and aft seat positions unhindered by the locking mechanism; and an actuator operatively connected between the seat and the locking mechanism so as to configure the locking mechanism either in the disengaged state upon the seat bearing a rated force or in the engageable state absent the rated force, wherein the locking mechanism includes a pair of lockable components and a latch movably connected to a first component of the lockable components to be movable relative to a second component of the lockable components between a disengaged position and an engaged position, the latch biased toward the engaged position and actuable toward the disengaged position, and the latch has a latch connector pivotally connected to the first component and a retentive shape defined at a location spaced radially away from the latch connector, the retentive shape arranged to engage with the second component upon the locking mechanism being in the engageable state and the seat being in the rated seat position.

15. A movement stopping system for a mobile chair including a base, a joint assembly and a seat kinematically coupled to the base via the joint assembly to allow a movement of the seat relative to the base between a fore seat position and an aft seat position, the movement stopping system comprising:

a locking mechanism including a pair of lockable components adapted to be mountable to the chair and a latch movably connected to a first component of the lockable components to be movable relative to a second component of the lockable components between a disengaged position and an engaged position, the latch biased toward the engaged position and actuable toward the disengaged position, the lockable components being movable relative to one another between a first following position and a second following position of a range of following positions, and the second lockable component being caught by the latch upon the latch moving into the engaged position with the lockable components being at a lockable position of the range of following positions, the latch being clear of the second component when in the disengaged position, and an actuator operatively connected to the latch and operable to urge the latch into the disengaged position, wherein the latch has a latch connector pivotally connected to the first component and a retentive shape defined at a location spaced radially away from the latch connector, the retentive shape arranged to slidably engage with the second component upon the lockable components being in the lockable position and the latch moving into the engaged position.

16. The movement stopping system of claim 15, wherein the first and the second components are configured to be mechanically attached to a respective one of the seat, the base and the joint assembly, and the actuator is configured to be operable via the seat.

17. The movement stopping system of claim 15, wherein the latch is a first latch of the locking mechanism and the actuator is a first actuator of the movement hindering system, the locking mechanism including a second latch movably connected to the first component to be movable relative to the second component between a respective disengaged position and a respective engaged position, biased toward the respective engaged position and actuable toward the respective disengaged position, the second latch interlocking the lockable components at a respective lockable position of the range of following positions when in the respective engaged position, the second latch being clear of the second component when in the respective disengaged position, and the movement stopping system including a second actuator operatively connected to the second latch and configured to be operable via the seat such that the first latch and the second latch are actuable independently.

18. The movement stopping system of claim 15, wherein the latch is biased to pivot relative to the first component away from the disengaged position and toward the engaged position, the actuator including an input device and a cable arranged between the input device and the latch such that the cable is tensionable via the input device so as to force the latch to pivot away from the engaged position to the disengaged position upon the input device bearing a rated force.

19. The movement stopping system of claim 18 wherein the actuator has a sliding mechanism arranged for increasing an effective length of the cable.

20. A self-stopping mobile chair system comprising:

a chair including a base, a joint assembly and a seat kinematically coupled to the base via the joint assembly to allow a movement of the seat relative to the base between a fore seat position and an aft seat position;

a locking mechanism configurable between:

an engageable state in which the locking mechanism locks the seat so as to hinder the movement upon the seat being in a rated seat position between the fore and aft seat positions, the seat movable toward the rated seat position to be locked by the locking mechanism, and a disengaged state in which the seat is movable between the fore and aft seat positions unhindered by the locking mechanism; and an actuator operatively connected between the seat and the locking mechanism so as to configure the locking mechanism either in the disengaged state upon the seat bearing a rated force or in the engageable state absent the rated force, wherein the locking mechanism includes a pair of lockable components and a latch movably connected to a first component of the lockable components to be movable relative to a second component of the lockable components between a disengaged position and an engaged position, the latch biased toward the engaged position and actuable toward the disengaged position, the second lockable component being affixed to a link of the joint assembly being pivotally connected to the base and to the seat, and the first lockable component being affixed to one of the base and the seat.

* * * * *